US008702264B1

(12) United States Patent
Rashidi

(10) Patent No.: US 8,702,264 B1
(45) **Date of Patent: *Apr. 22, 2014**

(54) 2×2 DAWN LIGHT VOLUMETRIC FIXTURE

(76) Inventor: Hamid Rashidi, Commerce, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/291,648

(22) Filed: Nov. 8, 2011

(51) Int. Cl.

| | |
|---|---|
| ***F21V 21/00*** | (2006.01) |
| ***F21V 1/00*** | (2006.01) |
| ***F21V 5/00*** | (2006.01) |
| ***F21V 7/00*** | (2006.01) |
| ***F21S 4/00*** | (2006.01) |
| ***F21S 8/00*** | (2006.01) |

(52) U.S. Cl.
USPC ..... 362/147; 362/217.01; 362/217.05; 362/217.1; 362/217.15; 362/223

(58) Field of Classification Search
USPC ..... 362/147, 148, 217.05, 217.02, 217.1, 362/249.02, 241, 245, 364, 296.01, 308, 362/327, 20, 217.01, 217.15, 223
See application file for complete search history.

(56) References Cited

U.S. PATENT DOCUMENTS

| | | | | | |
|---|---|---|---|---|---|
| 3,710,094 | A * | 1/1973 | Monte et al. | ..... | 362/218 |
| 3,860,829 | A * | 1/1975 | Fabbri | ..... | 307/66 |
| 4,549,253 | A * | 10/1985 | Totten | ..... | 362/364 |
| 4,928,209 | A * | 5/1990 | Rodin | ..... | 362/221 |
| 5,440,466 | A * | 8/1995 | Belisle et al. | ..... | 362/222 |
| 5,823,663 | A * | 10/1998 | Bell et al. | ..... | 362/362 |
| 5,988,829 | A * | 11/1999 | Holder | ..... | 362/223 |
| 6,092,913 | A * | 7/2000 | Edwards, Jr. | ..... | 362/260 |
| 6,367,955 | B1 * | 4/2002 | Rhee | ..... | 362/368 |
| 6,752,513 | B2 * | 6/2004 | Plunk | ..... | 362/150 |
| 6,854,860 | B2 * | 2/2005 | Plunk | ..... | 362/147 |
| 6,908,212 | B2 * | 6/2005 | Schultz | ..... | 362/220 |
| 7,229,192 | B2 | 6/2007 | Mayfield | | |
| 7,296,910 | B2 * | 11/2007 | Mayfield et al. | ..... | 362/217.05 |
| 7,510,305 | B2 * | 3/2009 | Straton et al. | ..... | 362/294 |
| 7,635,198 | B2 * | 12/2009 | Mayfield et al. | ..... | 362/220 |
| 7,794,119 | B2 * | 9/2010 | Venhaus | ..... | 362/346 |
| 7,901,105 | B2 * | 3/2011 | Fowler et al. | ..... | 362/217.15 |
| 7,922,351 | B2 * | 4/2011 | Welker | ..... | 362/217.11 |
| 7,963,662 | B2 * | 6/2011 | Chung et al. | ..... | 362/223 |
| 8,100,551 | B2 * | 1/2012 | Mayfield et al. | ..... | 362/223 |
| 8,272,763 | B1 * | 9/2012 | Chinnam et al. | ..... | 362/249.07 |
| 8,360,620 | B1 * | 1/2013 | Rashidi | ..... | 362/364 |
| 2005/0201094 | A1 * | 9/2005 | Plunk | ..... | 362/260 |
| 2005/0281023 | A1 * | 12/2005 | Gould et al. | ..... | 362/217 |
| 2005/0281024 | A1 * | 12/2005 | Mayfield et al. | ..... | 362/221 |
| 2010/0224404 | A1 * | 9/2010 | Rippel et al. | ..... | 174/520 |
| 2011/0211343 | A1 * | 9/2011 | Chung et al. | ..... | 362/223 |
| 2012/0120645 | A1 * | 5/2012 | Hawkins et al. | ..... | 362/225 |

* cited by examiner

*Primary Examiner* — Jong-Suk (James) Lee
*Assistant Examiner* — Erin Kryukova
(74) *Attorney, Agent, or Firm* — Thomas I. Rozsa

(57) ABSTRACT

An LED or fluorescent recessed lighting fixture having a pair of aligned LED boards or a pair of fluorescent bulbs each shielded by a diffuser. Each diffuser is retained by an angled wall and a portion of a V-shaped diffuser cover. The apparatus includes light emitted from a light source toward the location where the light is to illuminate the area. A reflector assembly is set in a straight line at an angle in the range of 45 degrees. A lens covers the light source and is retain by a portion of the reflector and a V-shaped basket.

25 Claims, 26 Drawing Sheets

2×2 DAWN LIGHT VOLUMETRIC FIXTURE

BACKGROUND OF THE INVENTION

1. Field of the Invention

The present invention relates to the field of recessed lighting systems which utilize either light emitting diodes ("LEDs") or fluorescent lighting to provide non-glaring interior lighting.

2. Description of the Prior Art

In general, the concept of utilizing LEDs and/or fluorescent lights in recessed lighting fixtures has been known. However, the source of illumination is frequently visible, making for an unattractive source of lighting.

In the prior art, there have been various lighting fixtures which provide direct lighting. However, in most of these cases, the source of illumination is frequently visible to the individuals in the room in which the light is being used. Another embodiment includes a fluorescent lamp and a lens having prismatic elements for distributing the light. There are also some light fixtures which include parabolic fixtures in the light.

The most common source of indoor lighting, especially for business uses, has been a fluorescent lighting fixture. One problem with fluorescent lighting fixtures is sometimes they emit light which is too bright for the area.

Another disadvantage that is found in traditional parabolic and prismatic troffers is the presence of distracting dynamic changes in brightness level and patterns as seen by a moving observer in the architectural space.

There have been various sources of solutions to resolve the problems with the prior art. One example is found in U.S. Pat. No. 7,229,192 issued to Mayfield, III et al. on Jun. 12, 2007, for "LIGHT FIXTURE AND LENS ASSEMBLY FOR SAME". In that patent, the disadvantages of light fixtures using brighter light sources by providing a configuration that appears to the viewer as though it has a source of lower brightness, but which otherwise permits the light fixture to advantageously and efficiently distribute the light generated by the selected lamp such as T5 lamp was allegedly resolved. The light fixture of that invention reduces directing direct light glare associated with high brightness light sources used in direct or indirect light fixtures. While the advantages of this patent are certainly of benefit, there is still significant room for improvement to improve the ability to reduce brightness and glare of sources of illumination, not only from fluorescent bulbs, but also from a source of light coming from light emitting diodes ("LEDs").

SUMMARY OF THE INVENTION

The present invention is a recessed lighting fixture which can utilize either an LED recessed lighting fixture which includes a multiplicity of LED boards which have a multiplicity of LEDs thereon, or a fluorescent light source. The LED boards and/or fluorescent lights are shrouded by a diffuser lens basket so that light from the LEDs or fluorescent bulbs shining through the diffuser is dispersed to reduce glare and visibility of the source of light.

The present invention relates to a light fixture for efficiently distributing light emitted by a light source into an area to be illuminated. The invention includes a light reflector assembly that supports the light source. A significant innovation of the present invention is that the light reflector assembly is straight and is neither concave nor convex but instead, provides a straight angular reflector which serves to improve the light source emission from LEDs as well as fluorescent bulbs.

The light fixture also includes a lens assembly positioned with respect to the source of illumination, which lens assembly is removably affixed in the manner as will be described hereinafter. In the preferred embodiment, the fixture includes two parallel lenses which are spaced apart and cover separate LED boards or separate fluorescent tubes.

In one embodiment of the present invention, the reflector assembly of the light fixture includes a base member that extends longitudinally between spaced edges along a longitudinal access. At least a portion of the base member can form a reflective surface which is preferably a straight non-curved reflecting surface. The light fixtures is typically higher up in the structure so that the illumination can be dimmed by the reflector assembly and lens as set forth hereinafter.

It is an object of the present invention to provide an LED recessed lighting fixture which has the illumination from the LEDs shining through a diffuser which can be made of frosted acrylic material or perforated metal so that the illumination appears to come from a fluorescent light.

It is an additional object of the present invention to provide an access door in the top of the fixture so that access to a driver or ballast retained within the fixtures can be provided from the top of the fixture.

It is also an object of the present invention to provide an access door in the top of the fixture so that access to an emergency ballast or emergency battery retained within the fixture can be provided from the top of the fixture.

It is also an object of the present invention to provide a single driver or diffuser within the body of the fixture where access can only be gained from below the fixture.

It is an additional object of the present invention to incorporate the above novel features into a fixture which utilizes fluorescent light bulbs as the source of illumination.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is an LED direct recessed lighting fixture and is also a direct recessed fluorescent lighting fixture for indoor lighting which includes a pair of diffuser lens baskets and reflectors. The fixture can be in various sizes. The preferred embodiment for the present invention has a generally square shape with a given length and width which by way of example can be 2 feet by 2 feet.

In the embodiment where the present invention LED direct recessed lighting fixture is designed to mimic a fluorescent light, it includes an LED fixture which is shrouded in a frosted acrylic or perforated metal diffuser to defuse the light emitted from the LEDs. Alternatively, the present invention is also a direct fluorescent lighting fixture.

Figure 8:
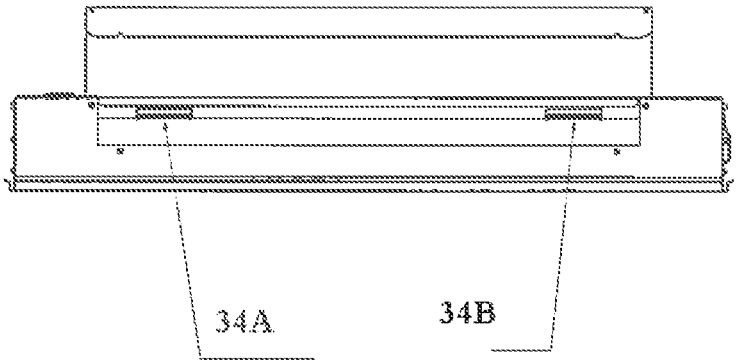
FIG. 8 is a front elevational view of the 2×2 dawn light fixture volumetric fixture illustrating the hinges by which the emergency access door rotates.

Referring to FIGS. 1-21, there is illustrated the embodiments of the present invention which are generally square shaped and can be approximately 2 feet long by 2 feet wide. The LED direct recessed lighting fixture 10 has a first lengthwise sidewall 12, a second parallel oppositely disposed lengthwise sidewall 14, a first transverse front wall 16A, a second transverse wall or rear wall 48 and a top surface or wall 80 which form a generally square shaped object. The front wall 16 has a top opening 18 and interior edge 20. Top surface or wall 80 has a first opening 82 which joins opening 18 in front wall 16. One of the unique innovations of the present invention is a first access door 30 having a top section 32 with an interior edge 34, the top section extending to a transverse section 35 having a lower edge 36 into which are formed a pair of spaced apart fastening members or teeth 38 and 40. The interior edge 34 of top section 32 of access door 30 is affixed to hinge 34A an 34B (See FIG. 8) where top access door 30 rotatably opens about hinges 34A and 34B. The lower edge 36 of transverse section 35 is removably affixed to interior edge 20 of first sidewall 16 by teeth 38 and 40. Referring to FIG. 3, the fixture 10 contains a driver or ballast 42 which is affixed to the interior surface 31 of access door 30. By incorporating first rapid access door 30, access to the driver 42 can be rapidly achieved from above the fixture 10 without having to dismantle the fixture from below.

Parallel oppositely disposed rear wall 48 has a top opening 50 and interior edge 52. Top wall 80 has a second opening 84 which joins opening 50 in second sidewall 48. A second unique innovation of the present invention is a second access door 60 having a top section 62 with an interior edge 64. The interior edge 64 of top section 62 of access door 60 is affixed to a hinge 65 where top access door 60 rotatably opens about hinge 65. The lower edge 66 of transverse section 67 is removably affixed to interior edge 52 of second transverse wall 48 by teeth 68 and 70. Referring to FIG. 3, the fixture 10 contains an emergency ballast or driver 72 which is affixed to the interior surface 65A of access door 60. By incorporating second rapid access door 60, access to the emergency ballast 72 can be rapidly achieved from above the fixture 10 without having to dismantle the fixture from below.

Figure 20:
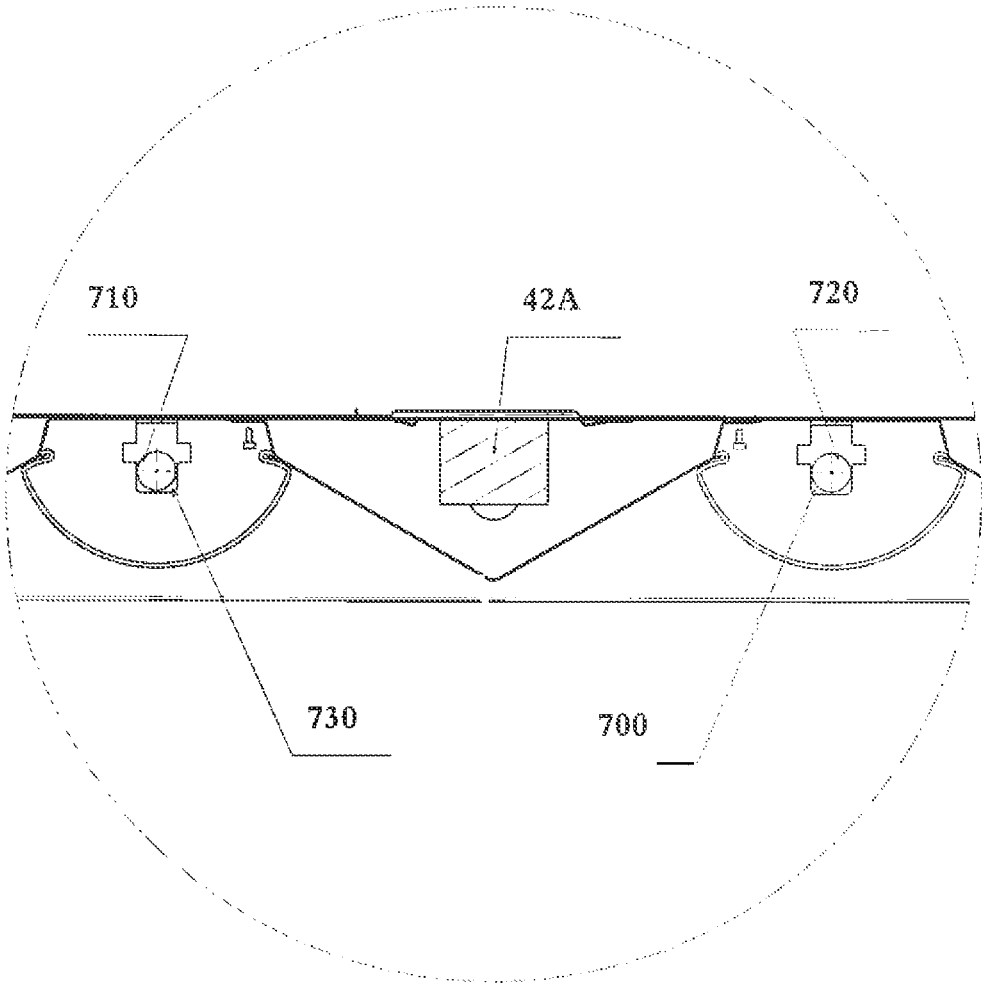
FIG. 20 is a cross-sectional view taken along line 20-20 of FIG. 18.

When a main ballast or driver 42 and emergency ballast or diver 72 is desired, they are on opposite sides of the fixture to provide balance. This is also illustrated in the cross-sectional view of FIG. 11. Sometimes, only one ballast is desired. In that design, the ballast 42A is centered in the fixture as illustrated in FIG. 20 and this is only a main ballast and there is no emergency ballast in this design.

One key innovation of the present invention is that it is an LED recessed light which is designed to mimic a fluorescent light. Referring to FIGS. 9A through 13, the invention contains two spaced apart pairs of LED boards. By way of example only referring to FIG. 13, the present invention includes two LED boards 400 and 410 along one LED section 420 affixed to the underside or interior wall 86 of top wall 80. Both LED boards 400 and 410 are horizontally oriented and spaced apart so that the two LED boards extend for the entire width of the fixture 10. There is a second spaced apart parallel set of LED boards 430 and 440 along a second LED section 450 affixed to the underside or interior wall 86 of top wall 80.

Figure 13:
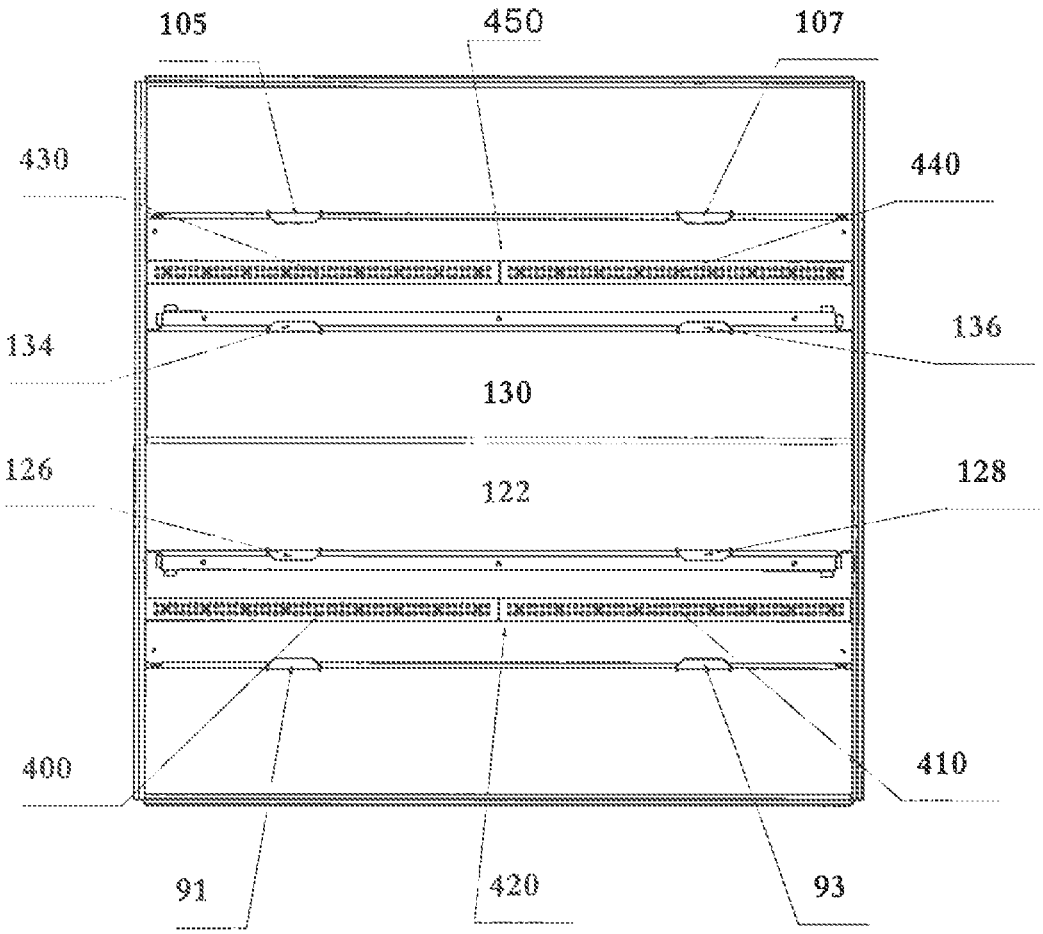
FIG. 13 is a bottom plan view of the fixture with the diffuser lenses removed, illustrating the printed circuit boards.
Figure 13A:
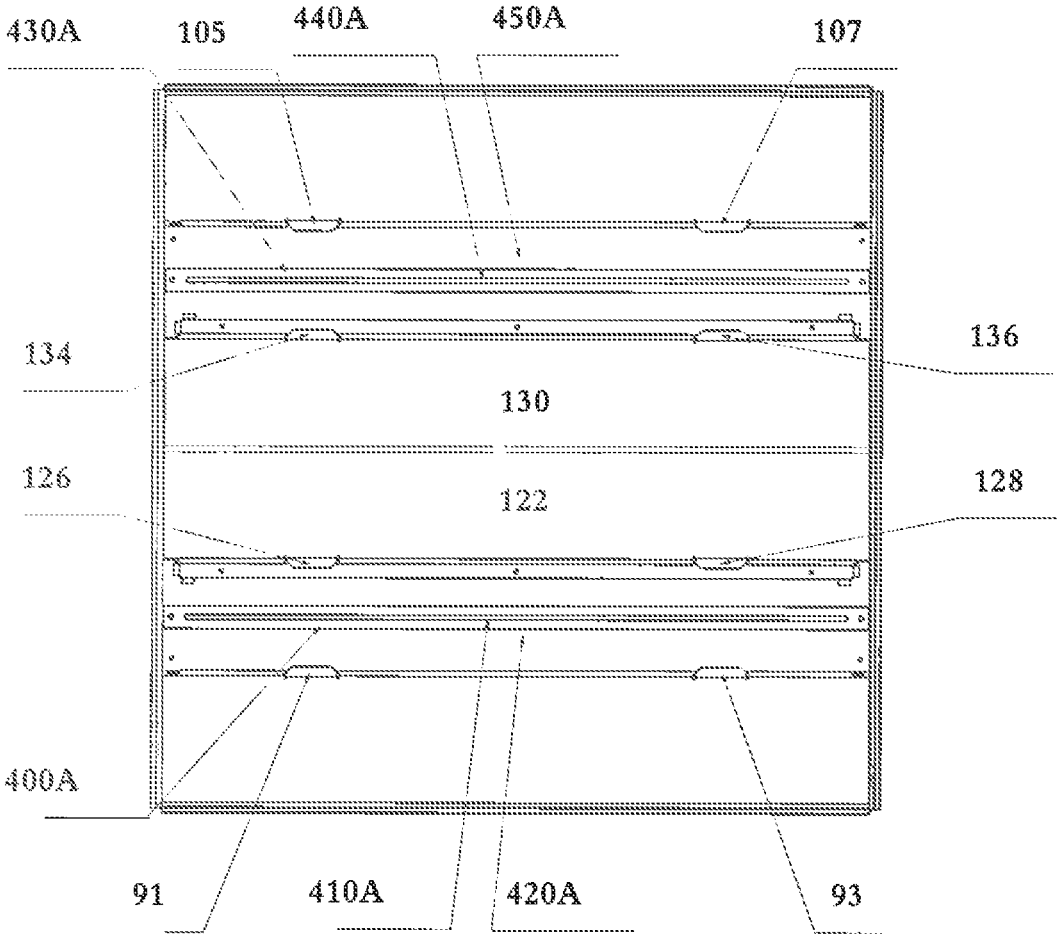
Figure 14:
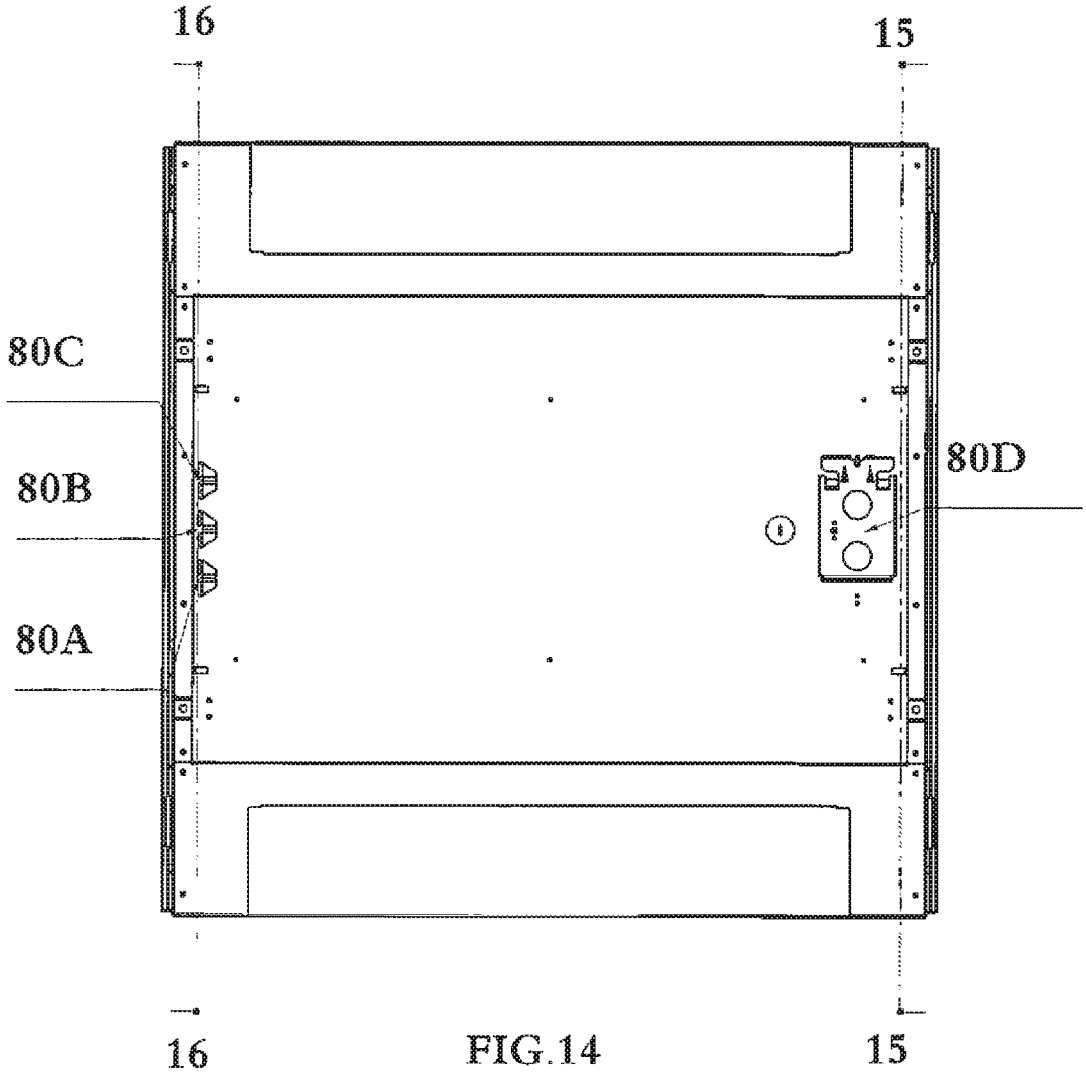
FIG. 14 is a top plan view of the 2×2 dawn light fixture with section lines 15-15 and 16-16.
Figure 15:
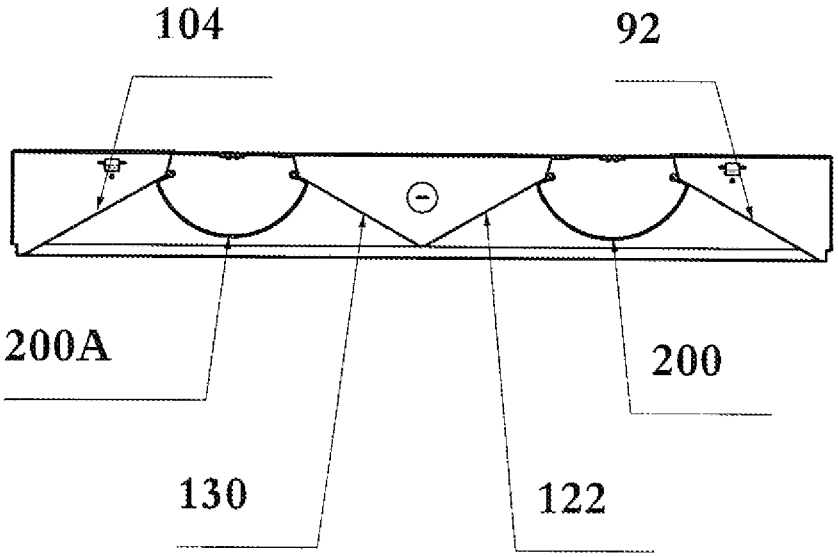
FIG. 15 is a cross-sectional view taken along line 15-15 of FIG. 14.
Figure 16:
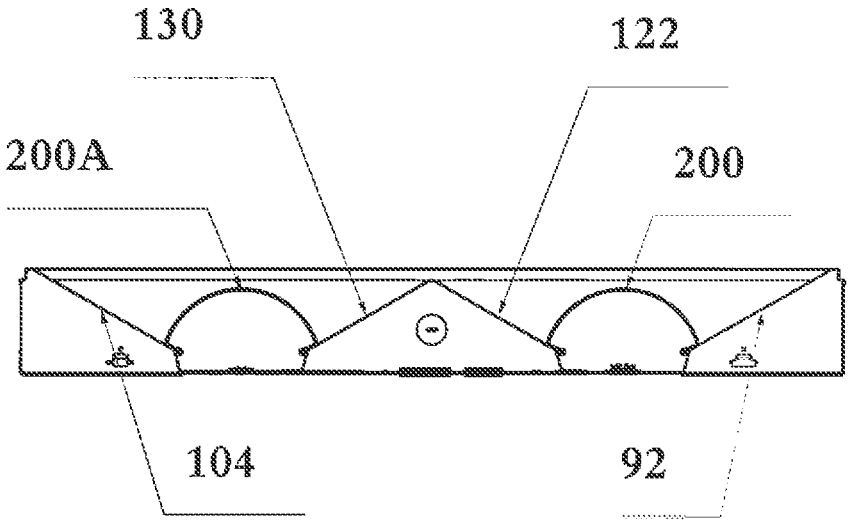
FIG. 16 is a cross-sectional vie take along line 16-16 of FIG. 14.
Figure 17:
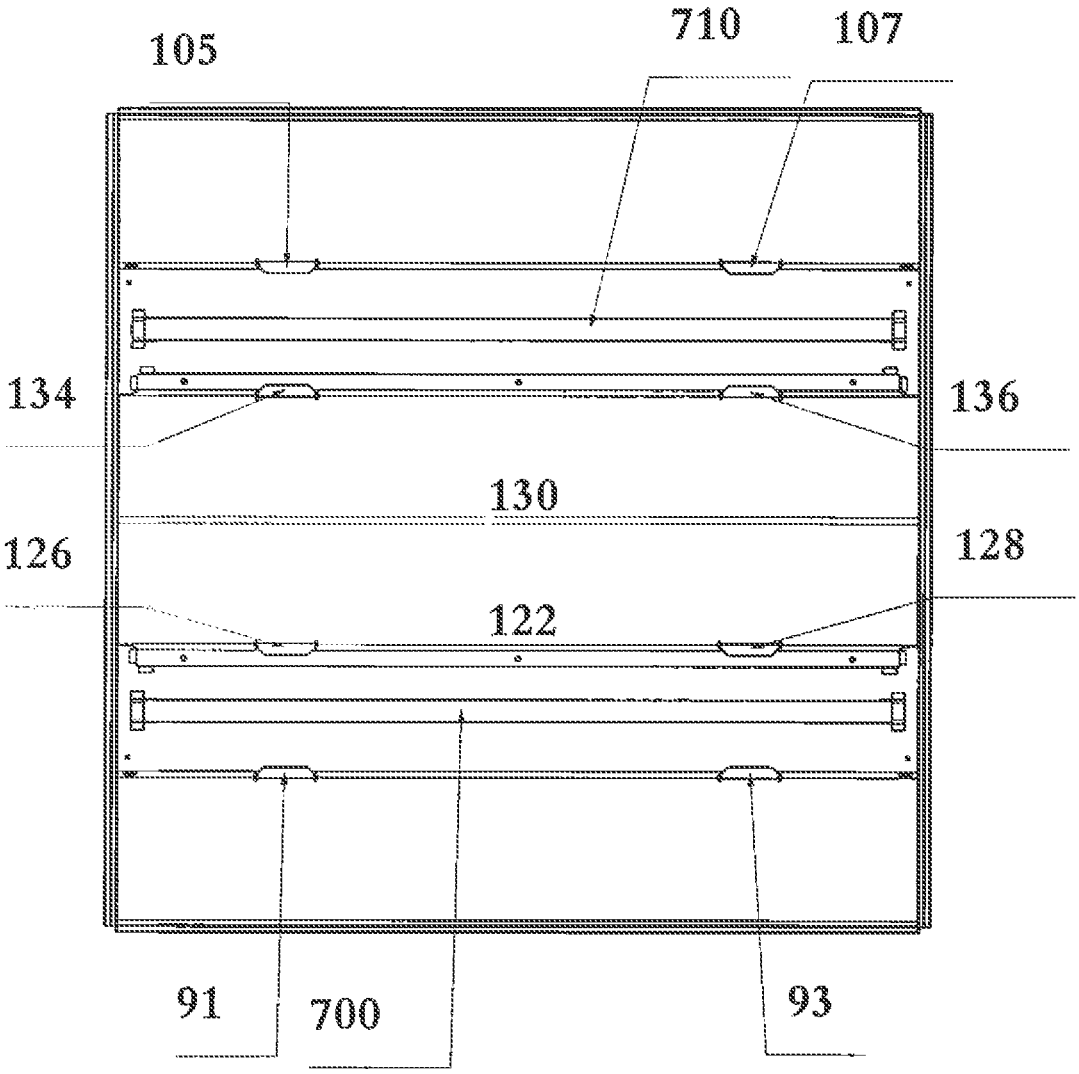
FIG. 17 is a bottom plan view of the fixture with the diffuser lenses removed illustrating a fluorescent light fixture.
Figure 18:
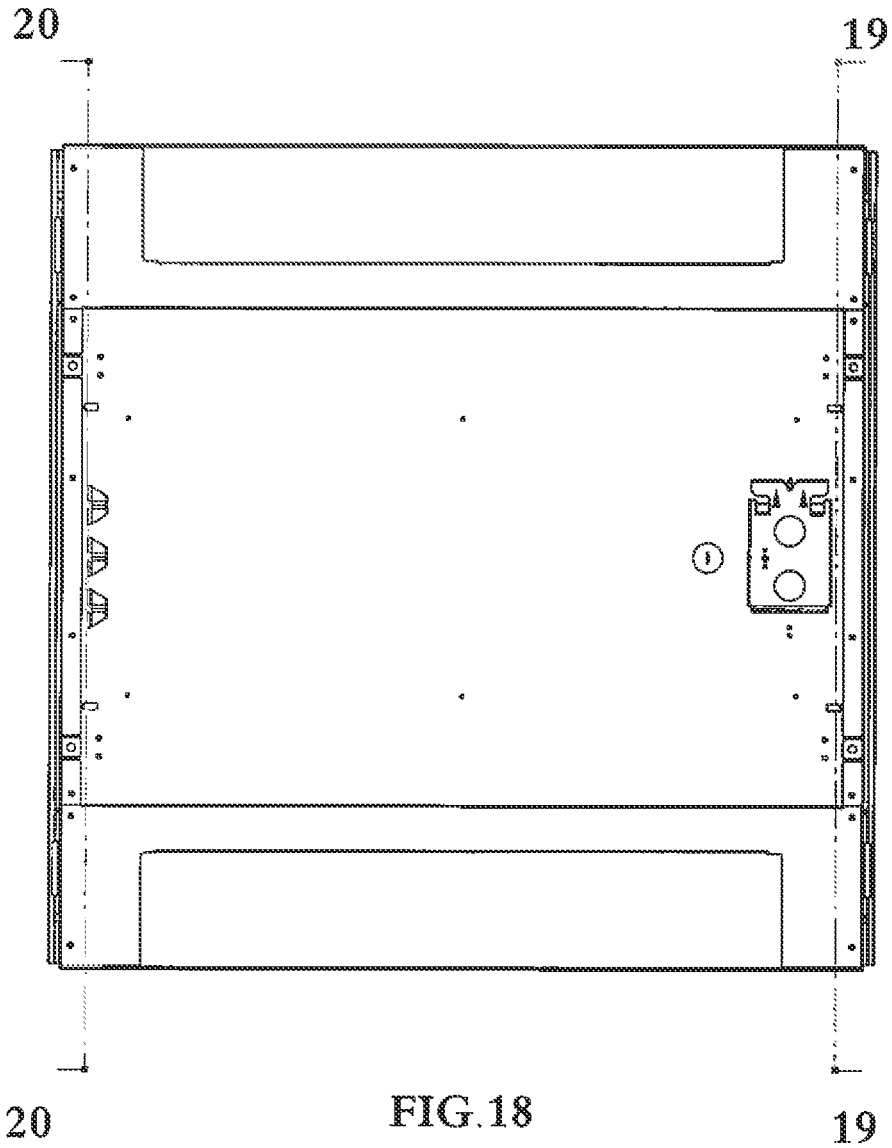
FIG. 18 is a top plan view of the 2×2 dawn light fixture with section lines 19-19 and 20×20.

Alternatively, by way of example only referring to FIG. 13A, the present invention includes at least one LED board 400A having at least one LED 410A along one LED section 420A affixed to the underside or interior wall 86 of top wall 80. The at least one LED board 400 is horizontally oriented and spaced apart so that the at least one LED board extends for the entire width of the fixture 10. There is a second spaced apart parallel at least one LED board 430A having at least one LED 440A along a second LED section 450A affixed to the underside or interior wall 86 of top wall 80.

It will be appreciated that while two LED boards 400, 410, 430 and 440 are illustrated in each respective set 420 and 450, it is within the spirit and scope of the present invention to have at least one LED board being horizontally disposed. The body comprising sidewalls 12 and 14 and front wall 16 and rear wall 48 and top wall 80 all act as a heat sink for the LEDs.

One of the unique innovations of the present invention is that each set of the LED boards 400, 410, 430 and 440 respectively are shrouded in a frosted acrylic or perforated metal diffuser lens 200 or 200A (see FIG. 3) which is in the shape of a longitudinal basket extending the entire interior width of the fixture 10 and which serves to diffuse the light from the LEDs.

Figure 9A:
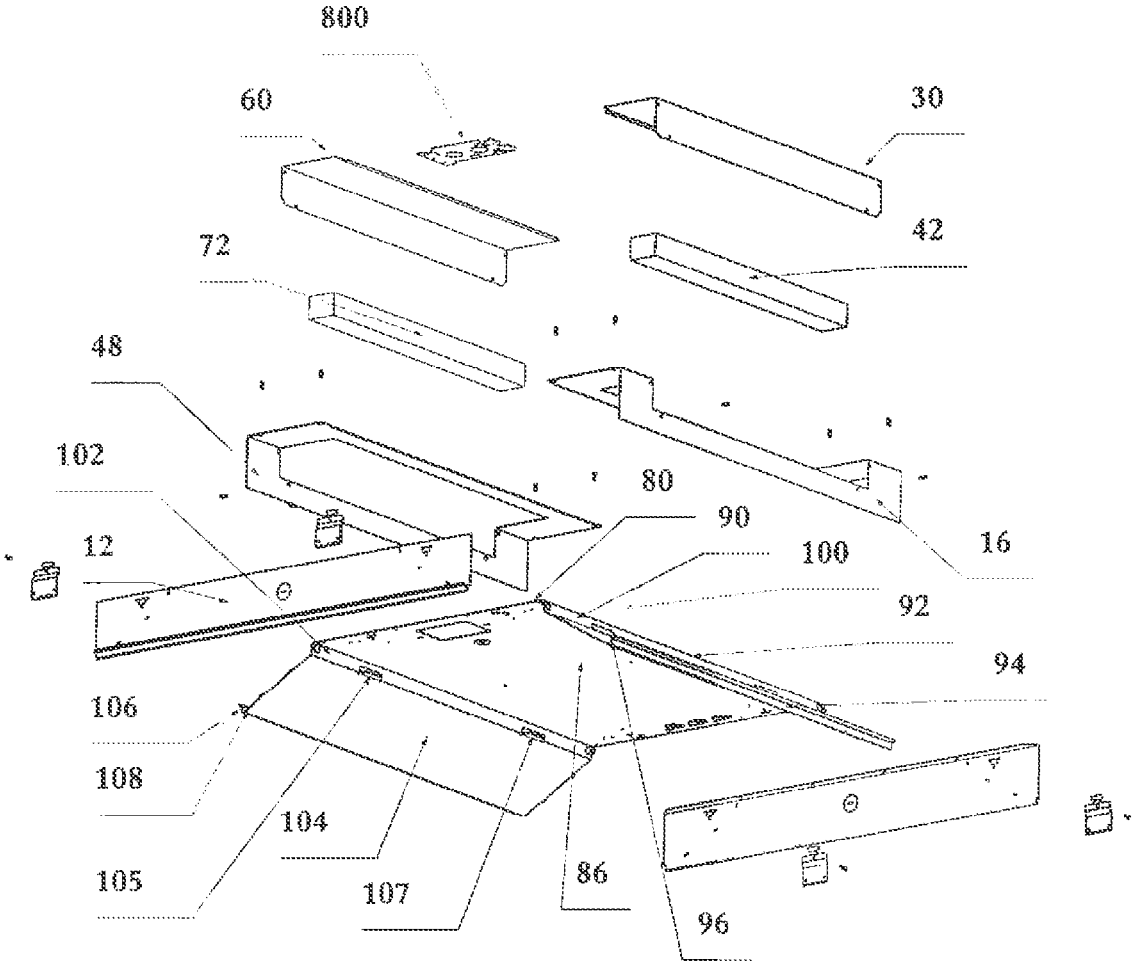
FIG. 9A is an exploded view illustrating some of the component parts of the body of the 2×2 dawn light volumetric fixture.
Figure 9B:
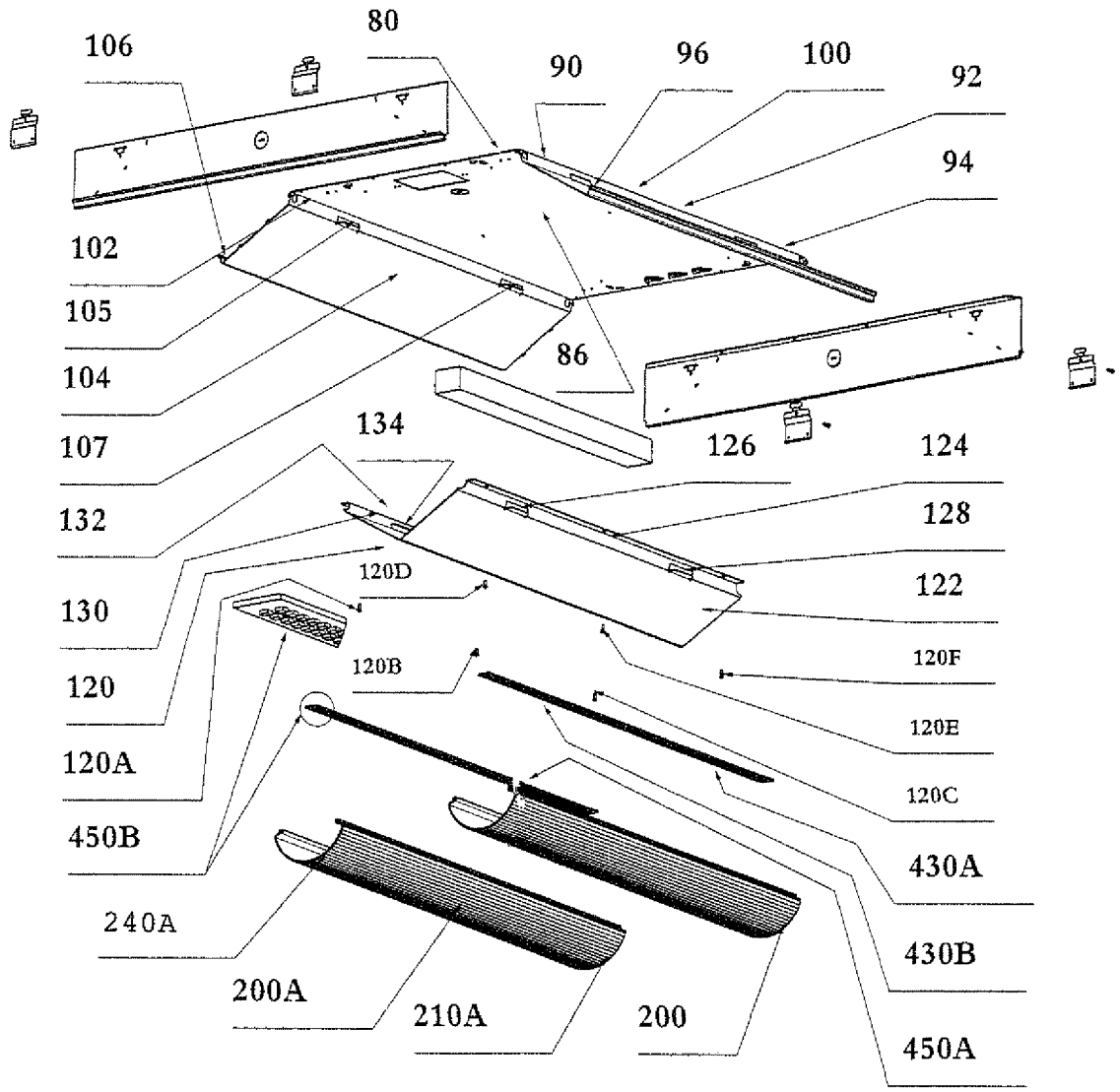
FIG. 9B is an exploded view illustrating additional component parts of the 2×2 dawn light volumetric fixture.
Figure 10:
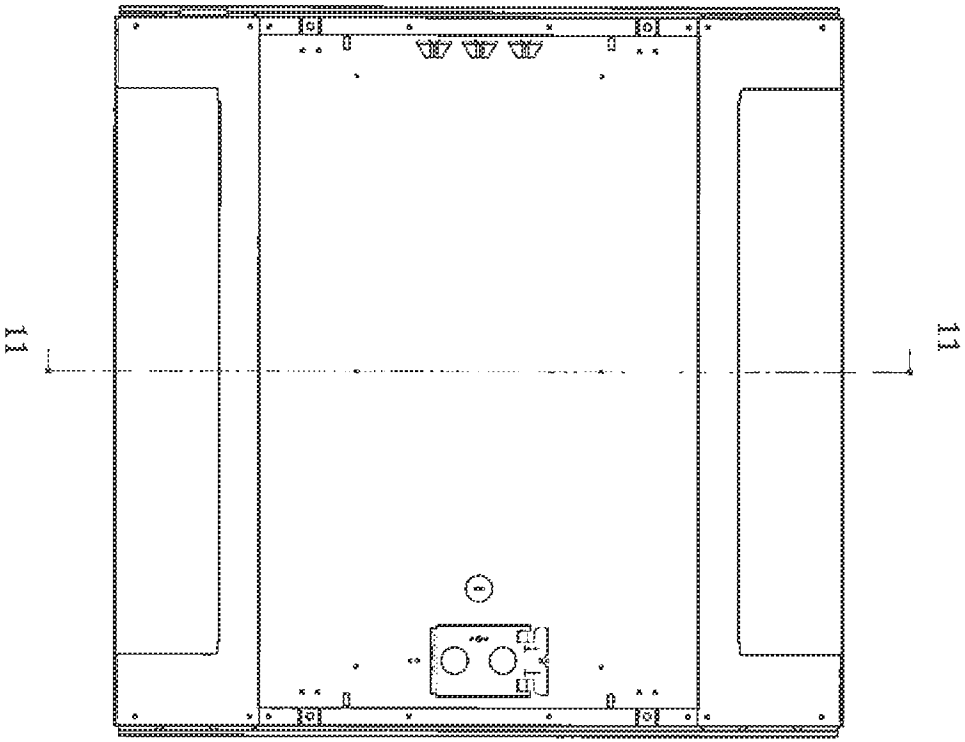
FIG. 10 is a top plan view of the 2×2 dawn light volumetric fixtures with section line 11-11.

The key physical components of the fixture 10 are illustrated in the exploded views of FIGS. 9A and 9B. The main body 100 comprises the top surface 80 and interior surface 86 of top surface 80. Top surface 80 extends to a first vertical interior transition wall 90 which in turn extends at a first angled wall 92 which extends at an angle relative to top surface 80 and terminates in a lower grooved wall 94 having a gap 96 between wall 94 and angled wall 92. Top surface 80 also extends to a second interior transition wall 102 which in turn extends to a second angled wall 104 which extends at an angle relative to top wall 80 and terminates in a lower grooved wall 106 having a gap 108 between wall 106 and second angled wall 104. First angled wall 92 and second angled wall 104 are mirror images of each other. First angled wall 92 has pair of spaced apart first channel receiving or gripping members 91 and 93 (see FIG. 13). Second angled wall 104 has a pair of spaced apart second channel receiving or gripping members 105 and 107. While the number 80 has been designated as the "top surface" throughout the text, it will be appreciated that it can also be referred to as the "top wall" for support in the claims.

Referring to FIG. 9B, the fixture 10 further comprises a V-shaped ballast cover 120 having a first angled wall 122 extending to a first vertical interior transition wall 124. A pair of spaced apart second channel receiving or gripping members 126 and 128 are located at the junction where the first angled wall 122 contacts the first vertical interior transition wall 124. The V-shaped ballast cover 120 also has a second angled wall 130 extending to a second vertical transition wall 132. A pair of spaced apart first channel receiving or gripping members 134 and 136 (see FIG. 13) are located at the junction where the second angled wall 130 contacts the second vertical interior transition wall 132.

First angled wall 92 and second angled wall 104 are straight—that means that they are neither convex or concave. Front wall 16 and rear wall 48 are each perpendicular to top wall 80—that means they are not at any angle other than 90 degrees relative to top wall 80.

Figure 12A:
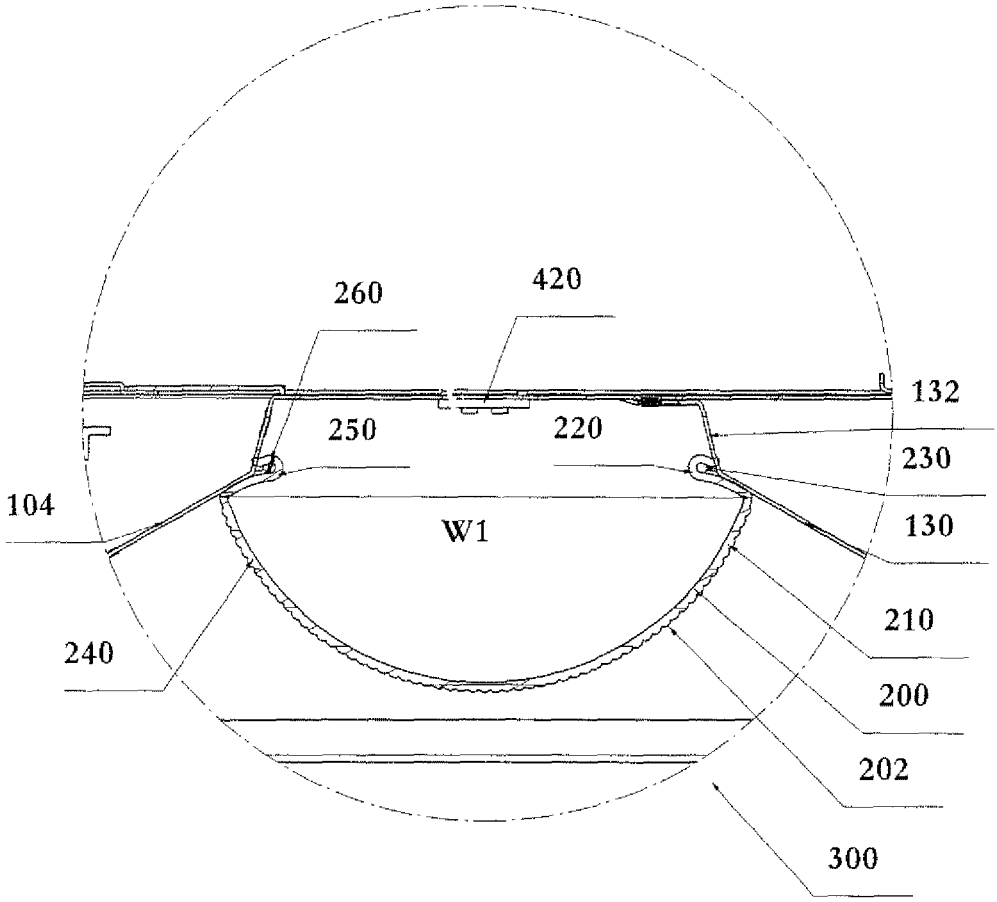
FIG. 12A is an enlarged view illustrating the first LED board and the first diffuser and attachment members.

Referring to FIG. 12A, the light from the LEDs is transmitted through the diffuser lens 200. An additional improvement is the incorporation of a wavy interior surface 202 on the exterior of the diffuser lens 200. The wavy interior surface causes the lights from the LEDs to bounce off the wavy surface and provide a smooth warm illumination glow. The wavy surface also serves to hide the spot locations where illumination from the LEDs are emitted.

As best illustrated in FIG. 12A, the diffuser lens 200 is arc shaped having a first arcuate sidewall 210 which terminates in a bent hook end 220 having a channel or gap 230 within the hook end 220. The diffuser lens 200 also has a parallel second arcuate sidewall 240 which terminates in a bent hook end 250 having a channel or gap 260 within the hook end 250. The diffuser lens 200 has a width "W1" which can range from approximately three (3) inches to approximately eight (8) inches. A first reflector support assembly 300 includes first receiving or gripping members 91 and 93 inserted into channel 230 of diffuser lens 200 and second gripping members 126 and 128 from first angled wall 122 of V-shaped ballast cover 120 are inserted into channel 260. The first angled wall 92 is supported by interior transition wall 90 affixed to interior surface 86 of top surface 80. V-shaped ballast cover 120 is affixed to interior surface 86 of top surface 80 by screws such as screws 120A, 120B, 120C, 120D, 120E and 120F illustrated in FIG. 9B. To remove diffuser lens 200, an inward force is applied to remove channel 230 from gripping members 91 and 93 or channel 260 is removed from first gripping members 126 and 128. The diffuser lens 200 covers LED boards 400 and 410.

Figure 12B:
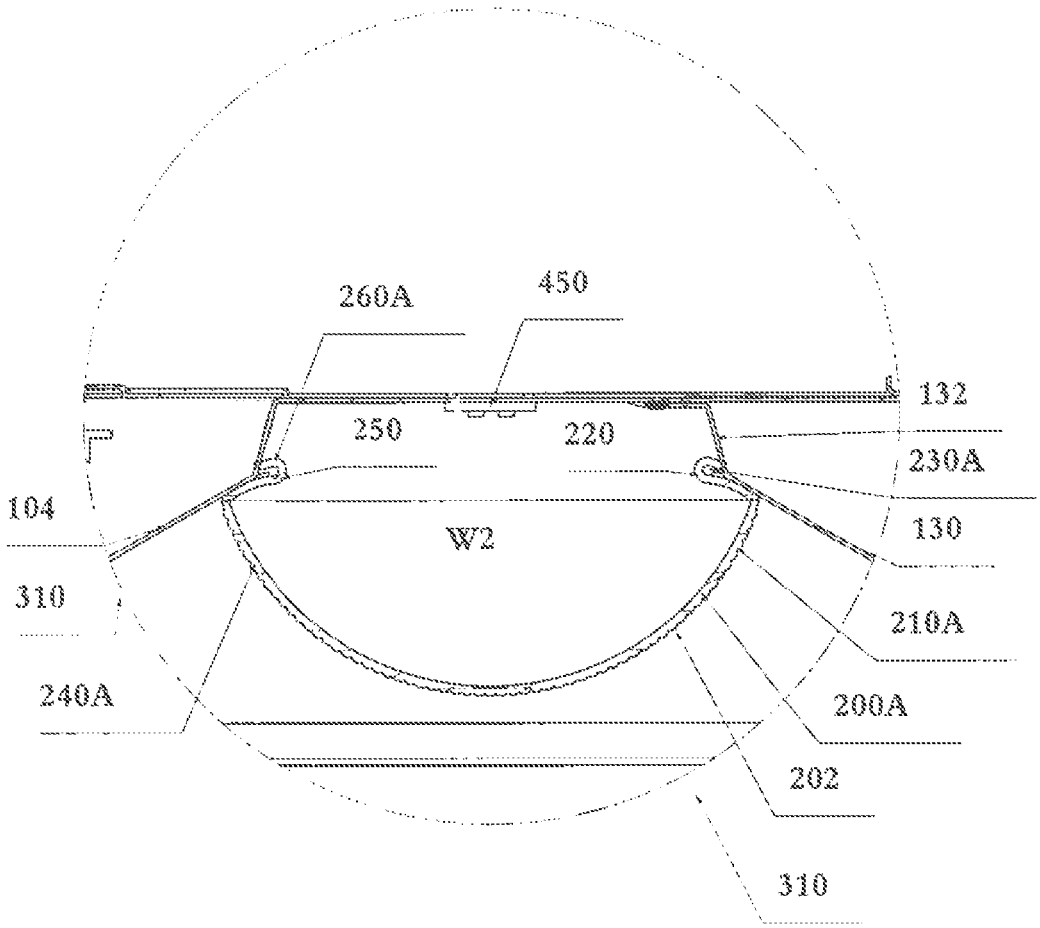
FIG. 12B is an enlarged view illustrating the second LED board and the second diffuser and attachment members.

Referring to FIG. 9B, parallel diffuser lens 200A covers LED boards 450A and 450B. As best illustrated in FIG. 12B, the diffuser lens 200A is arc shaped having a first arcuate sidewall 210A which terminates in a bent hook end 220A having a channel or gap 230A within the hook end 220A. The diffuser lens 200A also has a parallel second arcuate sidewall 240A which terminates in a bent hook end 250A having a channel or gap 260A within the hook end 250A. The diffuser lens 200A has a width "W2" which can range between approximately three (3) inches and approximately eight (8) inches. A second reflector support assembly includes second channel receiving or gripping members 134 and 136 from second angled wall 130 of V-shaped ballast cover 120 inserted into channel 230A of diffuser lens 200A and second gripping members 105 and 107 from second angled wall 104 are inserted into channel 260A. The second angled wall 104 is supported by interior transition wall 102 affixed to interior surface 86 of top surface 80. V-shaped ballast cover 120 is affixed to interior surface 86 of top cover 80 by screws such as screws 120A, 120B, 120C, 120D, 120E and 120F illustrated in FIG. 9B. To remove diffuser lens 200A, an inward force is applied to remove channel 230A from gripping members 134 and 136 or channel 260A is removed from gripping members 105 and 107 of second angled wall 104. The diffuser lens 200A covers LED boards 430 and 440.

Figure 11:
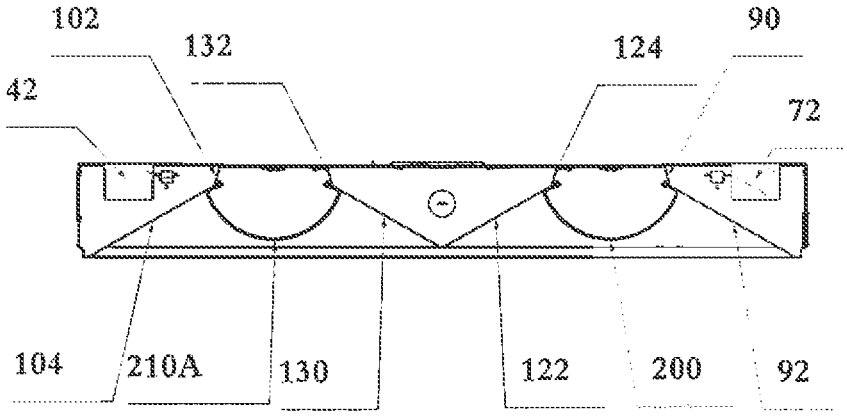
FIG. 11 is a cross-sectional view taken along line 11-11 of FIG. 10.
Figures 11A, 11B:
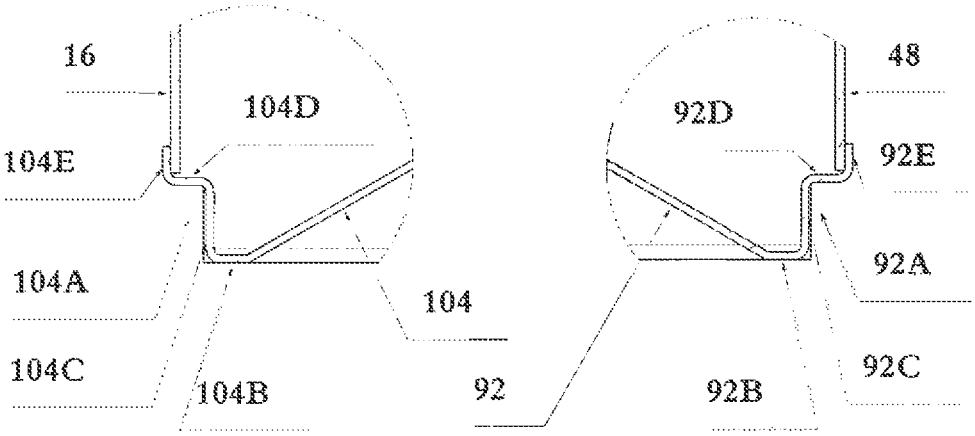
FIG. 11A is an enlarged view of the lower right hand corner illustrated in FIG. 11.
FIG. 11B is an enlarged view of the lower left hand corner illustrated in FIG. 11.

Referring to FIG. 11A, the straight first angled wall 92 extends at a downward approximately 45 degree angle and terminates in a bottom end 92A having a lower horizontal section 92B extending to a first vertical section 92C which extends to a second upper horizontal section 92D which extends to a second upper vertical section 92E. The bottom of sidewall 14 rests on upper horizontal section 92D and against upper vertical section 92E.

Referring to FIG. 11B, similarly the straight second angled wall 104 extends at a downward approximately 45 degree angle and terminates in a bottom end 104A having lower horizontal section 104B extending to a first horizontal section 104C which extends to a second upper horizontal section 104D which extends to a second upper vertical section 104E. The bottom of sidewall 12 rests on upper horizontal section 104C and against upper vertical section 104E.

Since the LED boards are horizontally oriented, light will shine through the respective diffusers 200 and 200A and give a glowing effect to the fixture 10. As a result, through the use of the diffusers 200 and 200A, the LEDs mimics a fluorescent light. The addition of the wavy interior surface 202 on the diffuser lens (and 200B on diffuser lens 200A) provides the added advantages previously discussed.

The driver 42 through which the system is powered is affixed to the lower surface of access door 30 as previously discussed and can be accessed from above through access door 30. In addition, to gain access from below, diffuser 200 is removed as previously described and the respective reflector assembly 300 will have to be removed.

On the opposite side of the fixture is the emergency battery pack or emergency ballast 72 which is affixed to the lower surface of access door 60 as previously discussed which enables access from above to the emergency battery pack 72. In addition, to gain access from below, diffuser 200A is removed by an inward force to remove the diffuser 200A and reflector assembly 310 will have to be removed.

If the ballast 42A is in the center affixed to interior surface 86 of surface 80, then the V-shaped ballast cover 100 will have to be removed to gain access to the center diffuser.

The purpose of the emergency battery pack or emergency ballast is to light some of the LEDs in the event power goes out so that an individual will have lighting to escape from a building should power go out.

The LEDs 400, 410, 430, and 440 are primarily white light but it is also within the spirit and scope of the present invention to have them in color and have them in different colors. It is believed that the fact that the LEDs on a board being in tandem in alternating rows is a new innovation of the present invention.

The pair of diffusers 200 and 200A are unique to the present invention.

Either or both of the drivers 42 and 72 or individual driver 42A can be a dimming driver. Alternatively, it is possible to have a dual level switch where two hot leads are brought in each switch independently that would turn on and off a subgroup of one of the subsets of the LED boards. By way of example, a dimming LED switch would have a dimming LED driver which would have a rotating switch wherein the amounts of light emitted from each of the LEDs would be varied and could be brighter or dimmer. Alternatively, the fixture can have dual level switch where the LEDs on boards 400 and 430 can be turned on with one switch and the LEDs on boards 410 and 440 can be turned on with a separate switch. This is only one example because any variation of a number of switches turning on the LEDS and respective boards is within the spirit and scope of the present invention. Therefore, it is within the spirit and scope of the present invention to have at least one board turned on with a switch and it is also possible to have two or three boards turned on with one switch and an alternatively two or three boards turned on with a second switch. Therefore, a user can use the full power mode the dimming mode on the driver.

The diffusers 200 and 200A are each primarily frosted acrylic although it can also be perforated metal. For the LEDs, there are different shades of white. There are a warm white, a cool white, daylight and possibly colored LEDs. Therefore, the LEDs 400, 410, 430 and 440 can be warm white, cool white, daylight, colored and true white.

In the case of the emergency battery pack or emergency diffuser 72, it will go on if the power goes out and at least a certain subset of the LEDs will be lit. The special circuit design will be a nickel cadmium battery for the emergency battery pack 72 so it will last at least 90 minutes and the idea is to preserve battery life so therefore, the emergency battery will only be lighting one subset of LEDs to provide light so that someone can exit the building in case there is an emergency.

Figure 1:
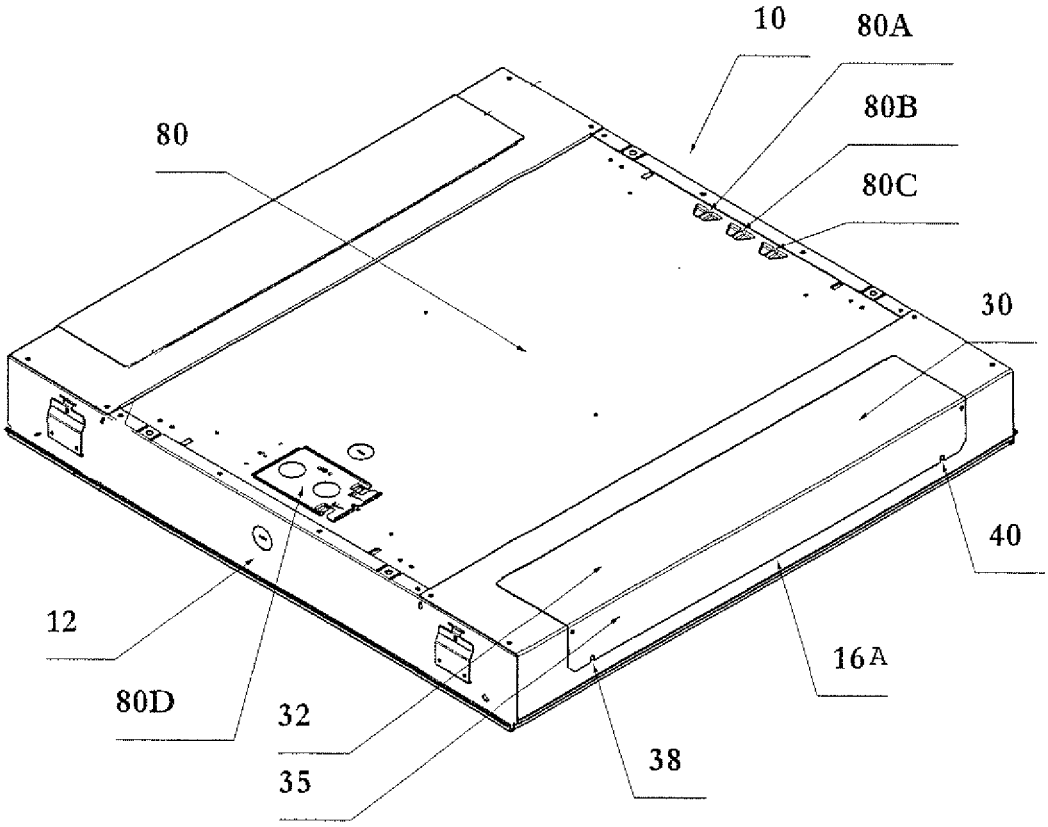
FIG. 1 is a top perspective view of the present invention 2×2 dawn light volumetric fixture which is generally square in shape, with the emergency access doors in the closed position.
Figure 2:
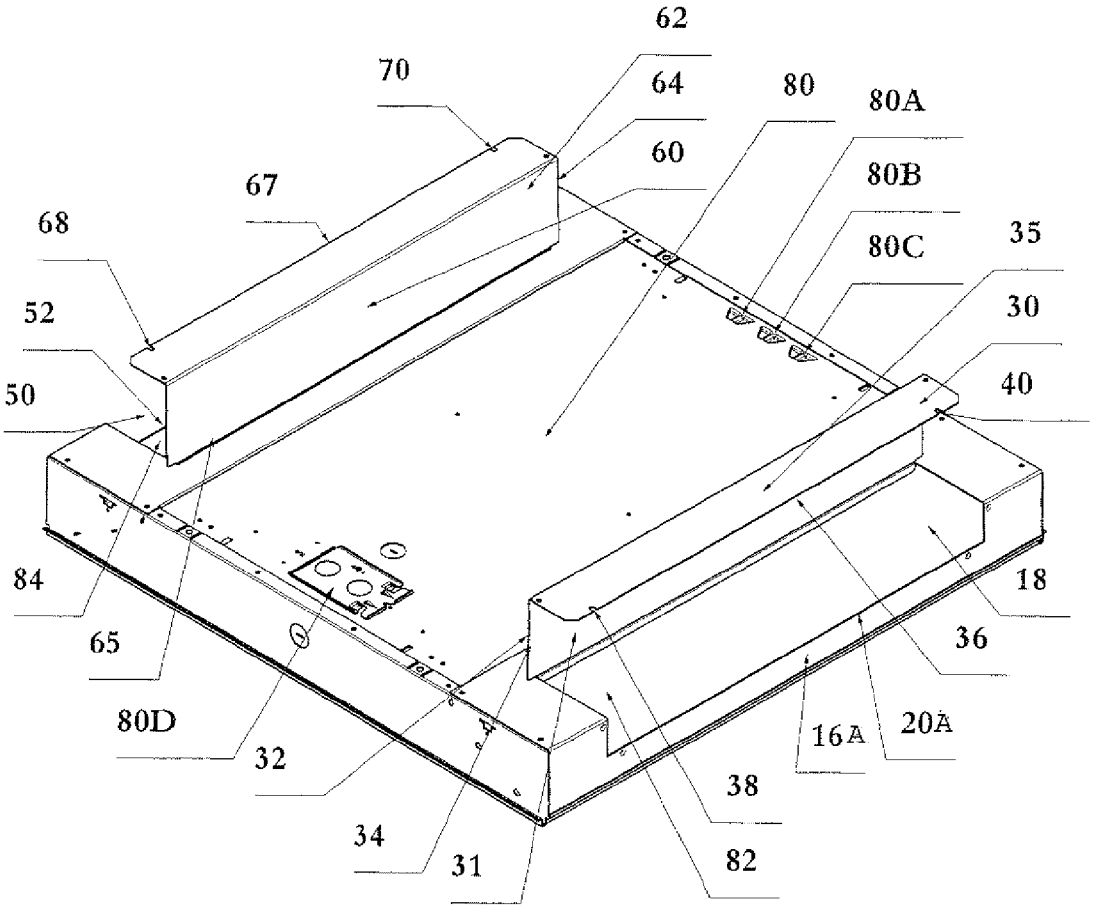
FIG. 2 is a top perspective view of the present invention 2×2 dawn light volumetric fixture with the emergency access doors in the opened position.
Figure 3:
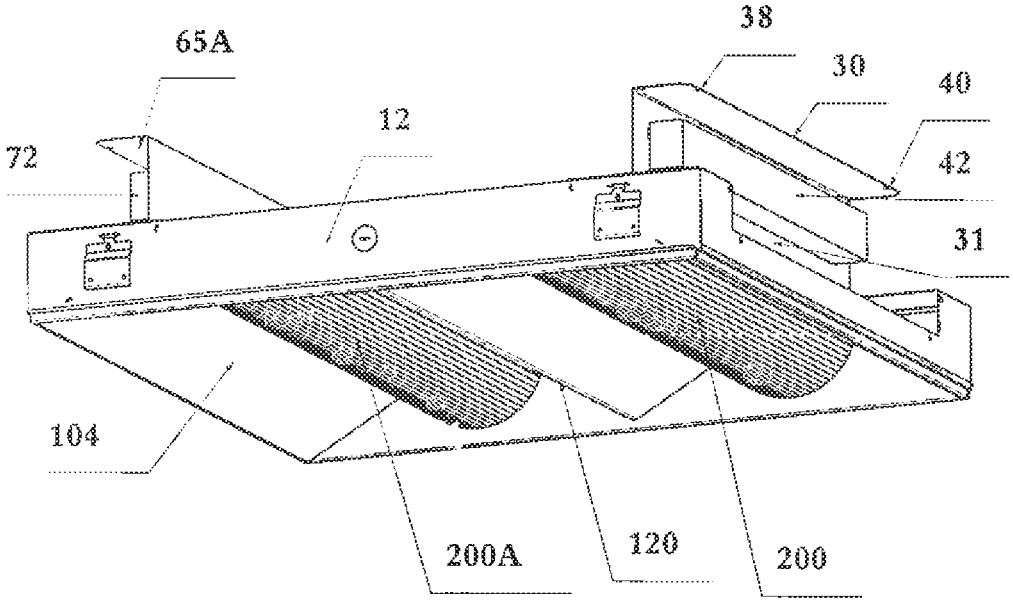
FIG. 3 is a bottom perspective view of the present invention 2×2 dawn light volumetric fixture with the emergency access doors open and illustrating the main ballast and emergency ballast respectively affixed to the emergency access doors, and illustrating the diffuser lenses and lens supporting structures in place.
Figure 4:
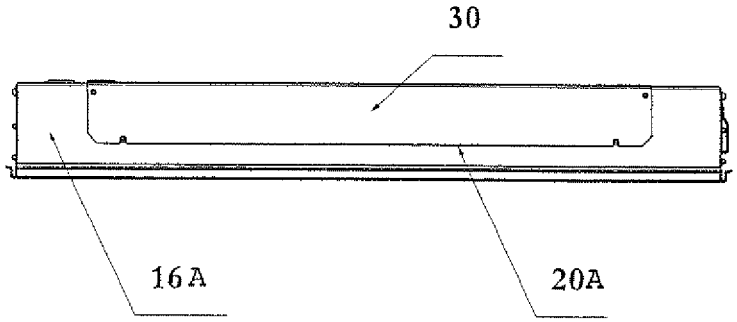
FIG. 4 is a front elevational view of the 2×2 dawn light volumetric fixture with the emergency access door closed.
Figure 5:
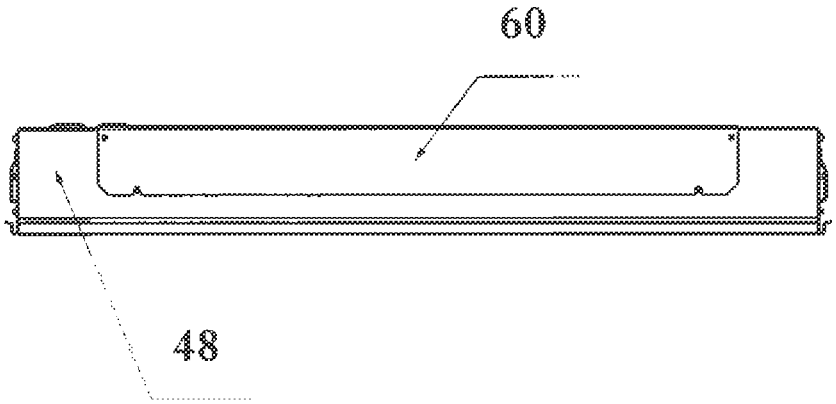
FIG. 5 is a rear elevational view of the 2×2 dawn light volumetric fixture with the emergency access door closed.

Referring to FIGS. 1 and 2, the top surface 80 has an access door 80D to gain access to the junction box for wiring. The top surface 80 also has knockouts 80A, 80B and 80C for electrical connection means to affix a central ballast.

Another key innovation of the present invention is that the 2×2 dawn lighting volumetric fixture can also retain fluorescent bulbs instead of LED boards. The LED boards are replaced with fluorescent bulbs 700 and 710. Referring to FIGS. 12C, 12D and 17 through 20, the invention contains two spaced apart fluorescent bulbs 700 and 710. Both fluorescent bulbs 700 and 710 are horizontally oriented so that the two fluorescent bulbs each respectively extend for the entire width of the fixture 10.

One of the unique innovations of the present invention is that each of the fluorescent bulbs 700 and 710 are respectively shrouded in a frosted acrylic or perforated metal diffuser lens 200 or 200A which is in the shape of a longitudinal basket extending the entire interior width of the fixture 10 and which serves to diffuse the light from the fluorescent bulbs.

The key physical components of the fixture 10 are illustrated in the exploded views of FIGS. 9A and 9B. The main body 100 comprises the top surface 80 and interior surface 86 of top surface 80. Top surface 80 extends to a first vertical interior transition wall 90 which in turn extends at a first angled wall 92 which extends at an angle relative to top wall 80 and terminates in a lower grooved wall 94 having a gap 96 between wall 94 and angled wall 92. Top surface 80 also extends to a second interior transition wall 102 which in turn extends to a second angled wall 104 which extends at an angle relative to top wall 80 and terminates in a lower grooved wall 106 having a gap 108 between wall 106 and second angled wall 104. First angled wall 92 and second angled wall 104 are mirror images of each other. First angled wall 92 has pair of spaced apart first channel receiving or gripping members 91 and 93. Second angled wall 104 has a pair of spaced apart second channel receiving or gripping members 105 and 107.

First angled wall 92 and second angled wall 104 are straight—that means that they are neither convex or concave. Front wall 16 and rear wall 48 are each perpendicular to top wall 80—that means they are not at any angle other than 90 degrees relative to top wall 80.

Referring to FIG. 9B, the fixture 10 further comprises a V-shaped ballast cover 120 having a first angled wall 122 extending to a first vertical interior transition wall 124. A pair of spaced apart second channel receiving or gripping members 126 and 128 are located at the junction where the first angled wall 122 contacts the first vertical interior transition wall 124. The V-shaped ballast cover 120 also has a second angled wall 130 extending to a second vertical transition wall 132. A pair of spaced apart first channel receiving or gripping members 134 and 136 are located at the junction where the second angled wall 130 contacts the second vertical interior transition wall 132.

The light from the fluorescent bulb 700 is transmitted through the diffuser lens 200. An additional improvement is the incorporation of a wavy interior surface 202 on the interior of the diffuser lens 200. The wavy interior surface causes the lights from the fluorescent bulb 700 to bounce off the wavy surface and provide a smooth warm illumination glow. The wavy surface also serves to hide the spot locations where illumination from the fluorescent bulb 700 is emitted.

Figure 12C:
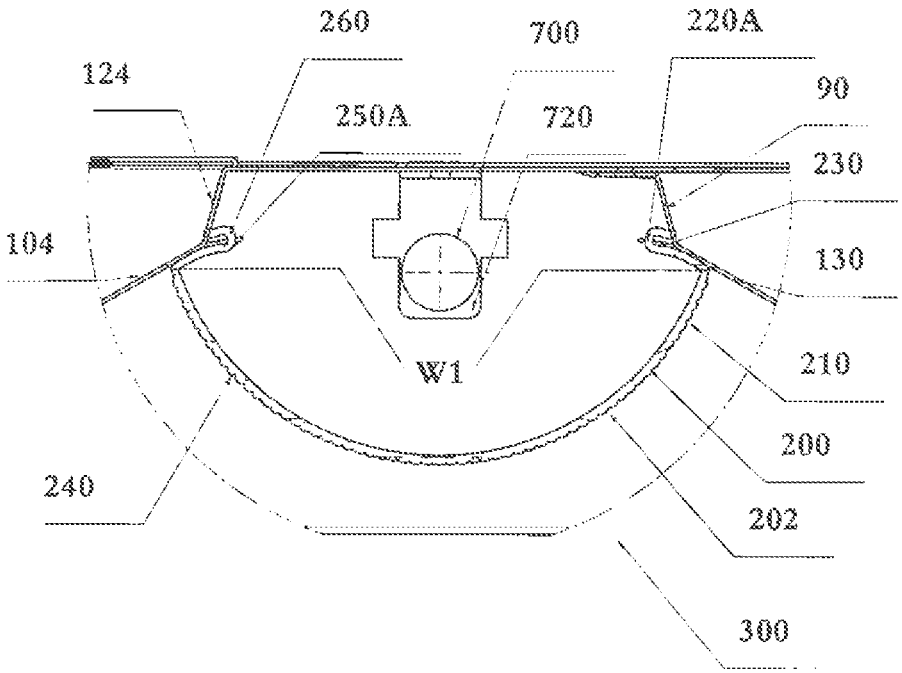
FIG. 12C is an enlarged view illustrating the first fluorescent bulb and the first diffuser and attachment members.
Figure 19:
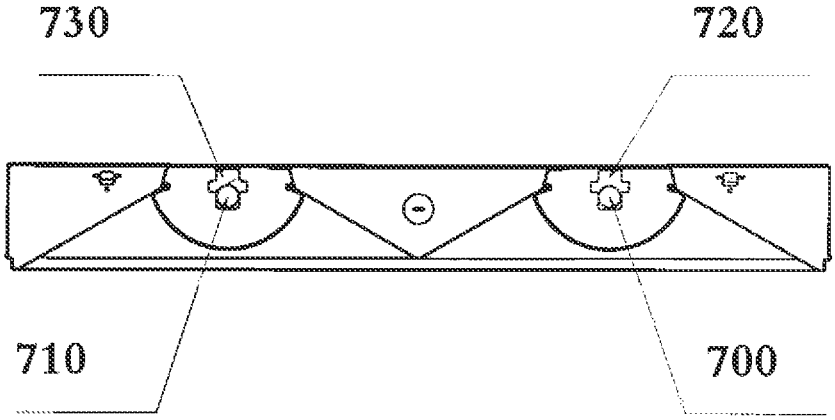
FIG. 19 is a cross-sectional view take along line 19-19 of FIG. 18.

As best illustrated in FIGS. 12C, 19 and 20, the diffuser lens 200 is arc shaped having a first arcuate sidewall 210 which terminates in a bent hook end 220 having a channel or gap 230 within the hook end 220. The diffuser lens 200 also has a parallel second arcuate sidewall 240 which terminates in a bent hook end 250 having a channel or gap 260 within the hook end 250. The diffuser lens 200 has a width W1 in the range of approximately three (3) inches to approximately eight (8) inches. A first reflector support assembly 300 includes first channel receiving or gripping members 91 and 93 inserted into channel 230 of diffuser lens 200 and second gripping members 126 and 128 from first angled wall 122 of V-shaped ballast cover 120 are inserted into channel 260. The first angled wall 92 is supported by interior transition wall 90 affixed to interior surface 86 of top surface 80. V-shaped ballast cover 120 is affixed to interior surface 86 of top surface 80 by screws such as screws 120A, 120B, 120C, 120D, 120E and 120F illustrated in FIG. 9B. To remove diffuser lens 200, an inward force is applied to remove channel 230 from gripping members 91 and 93 or channel 260 is removed from first gripping members 126 and 128. The diffuser lens 200 covers fluorescent bulb 700.

Figure 12D:
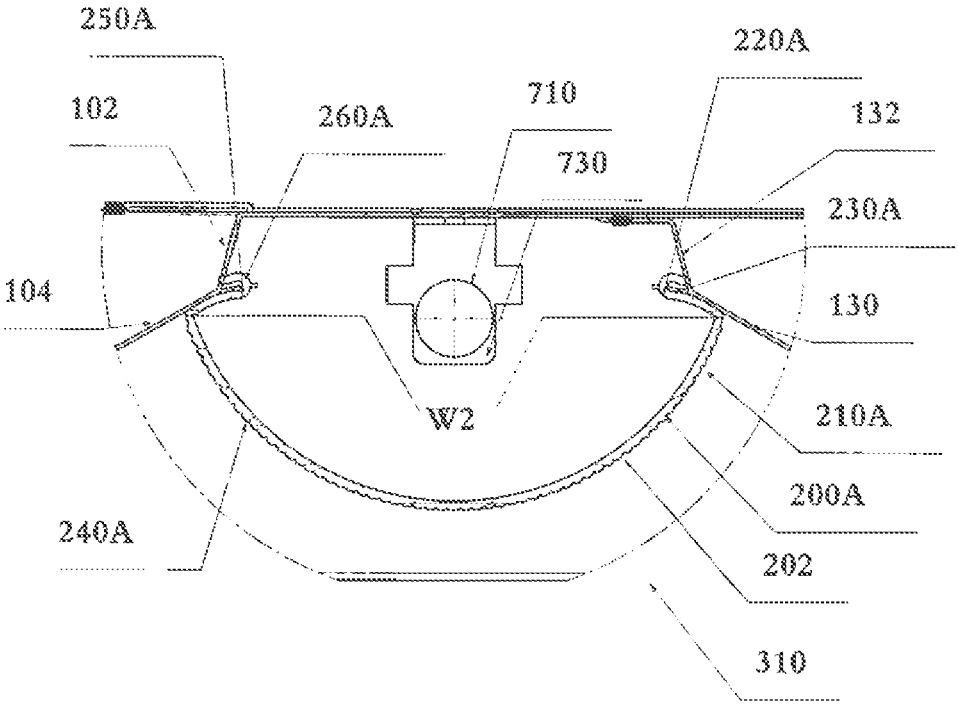
FIG. 12D is an enlarged view illustrating the second fluorescent bulb and the second diffuser and attachment members.

Referring to FIG. 12D, parallel diffuser lens 200A covers fluorescent bulb 710. As best illustrated in FIGS. 12D, 19 and 20, the diffuser lens 200A is arc shaped having a first arcuate sidewall 210A which terminates in a bent hook end 220A having a channel or gap 230A within the hook end 220A. The diffuser lens 200A also has a parallel second arcuate sidewall 240A which terminates in a bent hook end 250A having a channel or gap 260A within the hook end 250A. The diffuser lens 200A has a width W1 in the range of approximately three (3) inches to approximately eight (8) inches. A second reflector support assembly 310 includes second channel receiving or gripping members 134 and 136 from second angled wall 130 of V-shaped ballast cover 120 inserted into channel 230A of diffuser lens 200A and second gripping members 105 and 107 from the second angled wall 104 are inserted into channel 260A. The second angled wall 104 is supported by interior transition wall 102 affixed to interior surface 86 of top surface 80. V-shaped ballast cover 120 is affixed to interior surface 86 of top surface 80 by screws such as screws 120A, 120B, 120C, 120D, 120E and 120F illustrated in FIG. 9B. To remove diffuser lens 200A, an inward force is applied to remove channel 230A from gripping members 134 and 136 or channel 260A is removed from gripping members 105 and 107 of second angled wall 104. The diffuser lens 200A covers fluorescent bulb 710.

The straight first angled wall 92 extends at a downward approximately 45 degree angle and terminates in a bottom end 92A having a lower horizontal section 92B extending to a first vertical section 92C which extends to a second upper horizontal section 92D which extends to a second upper vertical section 92E. The bottom of sidewall 14 rests on upper horizontal section 92D and against upper vertical section 92E.

Similarly, the straight second angled wall 104 extends at a downward approximately 45 degree angle and terminates in a bottom end 104A having lower horizontal section 104B extending to a first horizontal section 104C which extends to a second upper horizontal section 104D which extends to a second upper vertical section 104E. The bottom of sidewall 12 rests on upper horizontal section 104C and against upper vertical section 104E.

As illustrated in FIGS. 19 and 20, sockets 720 and 730 are on opposite sidewalls 12 and 14 to retain fluorescent bulb 700. Diffuser 200 covers fluorescent bulb 700. Similarly, as illustrated in FIGS. 19 and 20, sockets 720 and 730 are on opposite sidewalls 12 and 14 to retain fluorescent bulb 710. Diffuser 200A covers fluorescent bulb 710.

The driver 42 through which the system is powered is affixed to the lower surface of access door 30 as previously discussed and can be accessed from above through access door 30. In addition, to gain access from below, diffuser 200 is removed as previously described and the respective reflector assembly 300 will have to be removed.

On the opposite side of the fixture is the emergency battery pack or emergency ballast 72 which is affixed to the lower surface of access door 60 as previously discussed which enables access from above to the emergency battery pack 72. In addition, to gain access from below, diffuser 200A is removed by an inward force to remove the diffuser 200A and reflector assembly 310 will have to be removed.

If the ballast 42A is in the center affixed to interior surface 86 of cover 80, then the V-shaped ballast cover 120 will have to be removed to gain access to the center diffuser. A single ballast 42A is most commonly used with fluorescent bulbs, but it is within the spirit and scope of the present invention to have two diffusers 42 and 72 also used with fluorescent bulbs.

The purpose of the emergency battery pack or emergency ballast is to light some of the LEDs in the event power goes out so that an individual will have lighting to escape from a building should power go out.

The fluorescent bulbs 700 and 710 are primarily white light but it is also within the spirit and scope of the present invention to have them in colors and have them in different colors.

The pair of diffusers 200 and 200A are is unique to the present invention.

Either or both of the drivers 42 and 72 or a single driver 42A can be a dimming driver. Alternatively, it is possible to have a dual level switch where two hot leads are brought in each switch independently that would turn on and off a subgroup of one of the subsets of the fluorescent bulbs. By way of example, a dimming switch would have a dimming driver which would have a rotating switch wherein the amounts of light emitted from each of the fluorescent bulbs would be varied and could be brighter or dimmer. Alternatively, the fixture can have dual level switching where a respective one of the fluorescent bulbs 700 can be turned on with one switch and the fluorescent bulb 710 can be turned on with a separate switch. This is only one example because any variation of a number of switches turning on the fluorescent bulbs. Therefore, it is within the spirit and scope of the present invention to have at least one fluorescent bulb turned on with a switch. Therefore, a user can use full power mode or dimming mode on the driver.

The diffusers 200 and 200A are each primarily frosted acrylic although it also can also be perforated metal.

In the case of the emergency battery pack or emergency diffuser 72, it will go on if the power goes out and at least a certain subset of the LEDs will be lit. The special circuit design will be a nickel cadmium battery for the emergency battery pack 72 so it will last at least 90 minutes and the idea is to preserve battery life so therefore, the emergency battery will only be lighting one subset of LEDs to provide light so that someone can exit the building in case there is an emergency.

Referring to FIG. 1, the top wall 80 has an access door 80D to gain access to the junction box for wiring. The top wall 80 also has knockouts 80A, 80B and 80C for wiring access.

Figure 6:
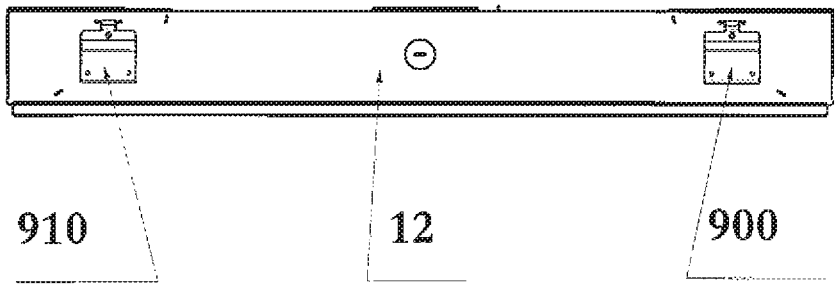
FIG. 6 is a left side elevational view of the 2×2 dawn light volumetric fixture.
Figure 7:
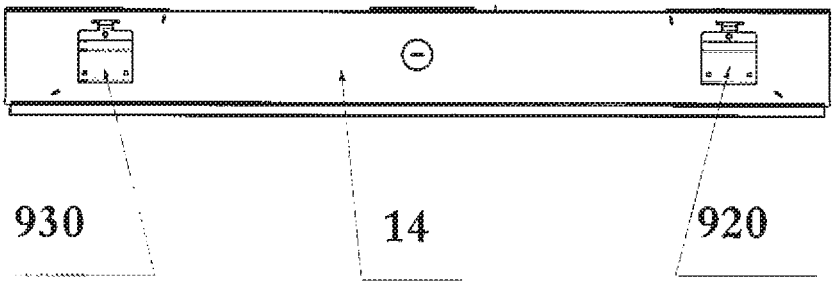
FIG. 7 is a right side elevational view of the 2×2 dawn light volumetric fixture.
Figure 21:
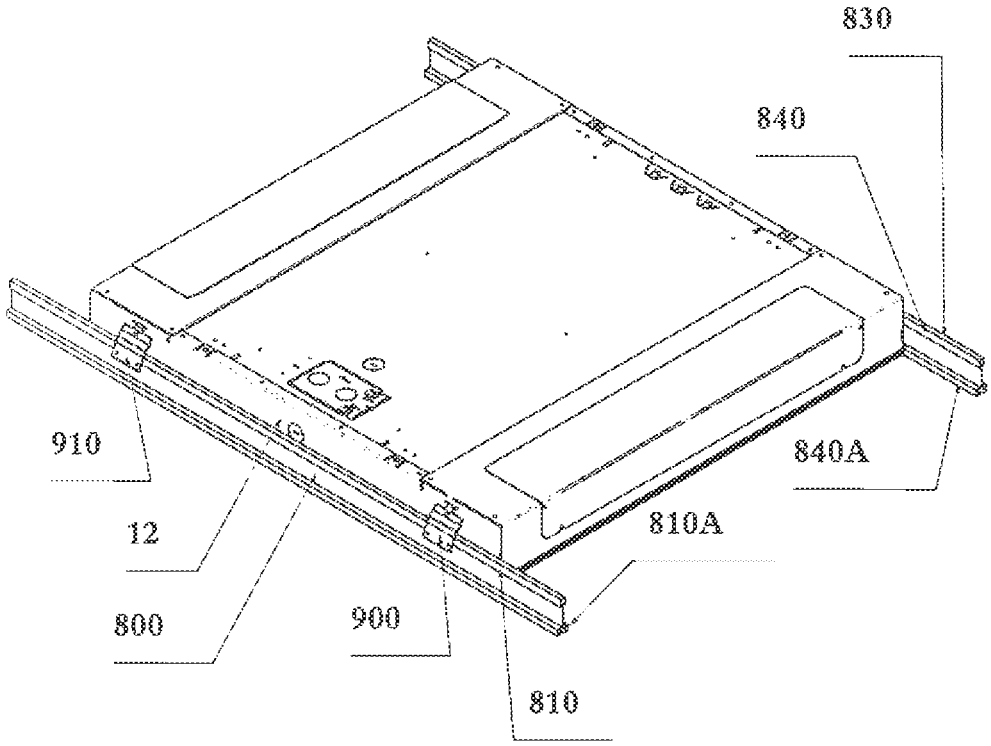
FIG. 21 is a perspective view of the 2×2 dawn light volumetric fixture attached to bar hangers.

Referring to FIGS. 6 and 21, the fixture 10 is affixed to a ceiling structure by parallel oppositely disposed fine hanger bars 800 and 830. First hanger bar 800 has an upper rail 810 which fits against lower horizontal section 92B and first vertical section 92C of first reflector support assembly 300 and is affixed to sidewall 12 by a pair of attachment clips 900 and 910 which is affixed to hanger bar 800 by screws at one end and to sidewall 12 at its opposite end. It also has a lower rail 810A which fits into gap 96. Similarly, referring to FIGS. 7 and 21, second hanger bar 830 has as upper rail 840 which fits against lower horizontal section 104B and first vertical wall 104C of second reflector support assembly 310 and it also has a lower rail 840A which fits into gap 108 and is affixed to sidewall 14 by a second pair of attachment clips 920 and 930 comparable to attachment clips 900 and 910.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An LED recessed direct lighting fixture comprising:

a. a housing having a first lengthwise sidewall, a second oppositely disposed lengthwise sidewall, a first transverse wall, a second transverse wall, a top surface, the first transverse wall perpendicular to the top surface and the second transverse wall perpendicular to the top surface b. a main body comprising a horizontal wall having a top surface, a first vertical interior transition wall, a first straight angled wall, the horizontal wall extending to the first straight angled wall which acts as a reflector and which extends at an angle relative to the top surface and terminates in a first lower grooved wall having a gap between the first lower grooved wall and first straight angled wall, the top surface also extends to a second vertical interior transition wall which in turn extends to a second straight angled wall which acts as a reflector and which extends at an angle relative to the top surface and terminates in a second lower grooved wall having a gap between the second lower grooved wall and second straight angled wall, the first straight angled wall and second straight angled wall are mirror images of each other;

c. the first straight angled wall has a pair of spaced apart first channel receiving or gripping members, the second straight angled wall has a pair of spaced apart second channel receiving or gripping members;

d. the fixture further comprises a V-shaped ballast cover having a first angled wall extending to a first vertical interior transition wall, and a pair of spaced apart second channel receiving or gripping members located at the junction where the first angled wall contacts the first vertical interior transition wall of the V-shaped ballast cover, the V-shaped ballast cover also comprises a second angled wall, a second vertical interior transition wall, and a pair of spaced apart first channel receiving or gripping members located at the junction where the second angled wall contacts the second vertical interior transition wall;

e. light from first and second LED boards affixed to the top surface of the main body is transmitted through a first diffuser lens, the first diffuser lens is arc shaped having a first arcuate sidewall which terminates in a first bent hook end having a first gap within the first bent hook end, the first diffuser lens also has a parallel second arcuate sidewall which terminates in a second bent hook end having a second gap within the second bent hook end, a first reflector support assembly which includes the pair of spaced apart first channel receiving or gripping members of the second straight angled wall inserted into the first gap in the first bent hook end of the first arcuate sidewall of the first diffuser lens and the spaced apart second channel receiving or gripping members from the first angled wall of the V-shaped ballast cover are inserted into the second gap within the second bent hook end of the second arcuate sidewall, the first straight angled wall is supported by the first vertical interior transition wall affixed to the top surface of the horizontal wall, the V-shaped ballast cover is affixed to the top surface of the horizontal wall by screws, so that to remove the first diffuser lens, an inward force is applied to remove the first gap from the pair of spaced apart first channel receiving or gripping members of the first arcuate sidewall or the second gap is removed from the spaced apart second channel receiving or gripping members of the V-shaped ballast cover, the first diffuser lens covers the first and second LED boards;

f. light from third and fourth LED boards affixed to the top surface of the main body is transmitted through a second diffuser lens, the second diffuser lens is arc shaped and covers the third and fourth LED boards affixed to the top surface of the main body, the second diffuser lens is arc shaped having a first arcuate sidewall which terminates in a first bent hook end having a first gap within the first bent hook end of the second diffuser lens, the second diffuser lens also has a parallel second arcuate sidewall which terminates in a second bent hook end having a second gap within the second bent hook end of the second diffuser lens, a second reflector support assembly includes a pair of spaced apart first channel receiving or gripping members from the second angled wall of the V-shaped ballast cover inserted into the first bent hook end of the second diffuser lens and the pair of spaced apart second channel receiving or gripping members from the second angled wall inserted into the second bent hook end of the second diffuser lens, the second angled wall is supported by the second vertical interior transition wall affixed to the top surface of the horizontal wall, the V-shaped ballast cover is affixed to the top surface of the horizontal wall by screws, to remove the second diffuser lens, an inward force is applied to remove the first bent hook end of the second diffuser lens from the pair of spaced apart first channel receiving or gripping members of the V-shaped ballast covers or the second bent hook end of the second diffuser lens is removed from the pair of spaced apart second channel receiving or gripping members of the second angled wall, the second diffuser lens covers the third and fourth LED boards;

g. the first straight angled wall extends at a downward approximately 45 degree angle and terminates in a bottom end having a lower horizontal section extending to a first vertical section which extends to a first upper horizontal section which extends to a first upper vertical section, the bottom of the second lengthwise sidewall rests on the first upper horizontal section and against the first upper vertical section;

h. similarly the second straight angled wall extends at a downward approximately 45 degree angle and terminates in a bottom end having a lower horizontal section extending to a first vertical section which extends to a second upper horizontal section which extends to a second upper vertical section, the bottom of the first lengthwise sidewall rests on the second upper horizontal section and against the second upper vertical section;

i. the main body, the first transverse wall, the second transverse wall, the first lengthwise sidewall and the second lengthwise sidewall acting as a heat sink for the LED boards; and j. the first straight angled wall is not concave and not convex and the second straight angled wall is not concave and not convex.

2. The LED recessed direct lighting fixture in accordance with claim 1, further comprising: a first opening in the top surface adjoining an opening in the first transverse wall with a first access door hingeably affixed to the top surface and covering the adjoined openings, a second opening in the top surface adjoining an opening in the second transverse wall with a second access door hingeably affixed to the top surface and covering the adjoined openings;

b. a driver housed within the fixture so that it is attached to and accessible from the first access door; and c. an emergency battery or second driver housed within the fixture so that it is attached to and accessible from the second access door.

3. The LED recessed direct lighting fixture in accordance with claim 1, further comprising:

a. a single driver attached to the top wall of the horizontal wall and is accessed by removing the V-shaped ballast cover and at least one diffuser.

4. The LED recessed direct lighting fixture in accordance with claim 1, further comprising: each diffuser being frosted and made of acrylic material.

5. The LED recessed direct lighting fixture in accordance with claim 1, further comprising: each diffuser being made of perforated metal.

6. The LED recessed lighting fixture in accordance with claim 1, further comprising the first and second lengthwise sidewalls and first and second transverse walls of the housing forming a generally square shape.

7. The LED direct recessed lighting fixture in accordance with claim 1 where during a power failure in which power to the fixture is interrupted, an emergency battery will enable a selected few of the LEDs on one of the LED boards to provide illumination for a given period of time.

8. The LED direct recessed lighting fixture in accordance with claim 1, further comprising dimming means by which the illumination from at least some of the LEDs is dimmed.

9. The LED direct recessed lighting fixture in accordance with claim 1, further comprising:

a. the fixture is affixed to a ceiling structure by parallel oppositely disposed fine hanger bars, a first hanger bar has an upper rail which fits against the first lower horizontal section and the first vertical section of the first reflector support assembly and is affixed to the first lengthwise sidewall by a pair of attachment clips which is affixed to the first hanger bar by screws at one end and to the first lengthwise sidewall, at its opposite end; and b. similarly, a second hanger bar has as upper rail which fits against the second lower horizontal section and the second vertical wall of the second reflector assembly and is affixed to the second lengthwise sidewall by a second pair of attachment clips.

10. The LED recessed lighting fixture in accordance with claim 1, further comprising: the fixture is approximately two (2) feet length and two (2) feet wide.

11. An LED recessed direct lighting fixture comprising:

a. a housing having a first lengthwise sidewall, a second oppositely disposed lengthwise sidewall, a first transverse wall, a second transverse wall, a top surface, the first transverse wall perpendicular to the top surface and the second transverse wall perpendicular to the top surface;

b. a main body comprising a horizontal wall having a top surface and interior surface, the top surface having a first vertical connecting member extending at a first straight angled wall, the top surface extending to the first straight angled wall which acts as a reflector and which extends at an angle relative to the top surface and terminates in a first lower grooved wall having a gap between the first lower grooved wall and first straight angled wall, the top surface also comprises a second vertical interior transition wall extending to a second straight angled wall which acts as a reflector and which extends at an angle relative to the top surface and terminates in a second lower grooved wall, the first straight angled wall and second straight angled wall are mirror images of each other;

c. the first straight angled wall has at least one first channel receiving or gripping member, the second straight angled wall has at least one spaced apart second channel receiving or gripping member;

d. the fixture further comprises a V-shaped ballast cover having a first angled wall and a first vertical connecting member, and at least one first channel receiving or gripping member, the V-shaped ballast cover also comprises a second angled wall and a second interior vertical connecting member, and at least one second channel receiving or gripping member;

e. light from at least one LED on a first LED board affixed to the interior surface of the main body is transmitted through a first diffuser lens, the first diffuser lens is arc shaped having a first arcuate sidewall which terminates in a first bent hook end having a first gap within the first bent hook end, the first diffuser lens also has a parallel second arcuate sidewall which terminates in a second bent hook end having a second gap within the second bent hook end, a first reflector support assembly which includes the at least one first channel gripping member of the first straight angled wall inserted into the first gap in the first bent hook end of the first arcuate sidewall of first diffuser lens and the at least one second channel receiving or gripping member from the first angled wall of the V-shaped ballast cover is inserted into the second gap within with the second bent hook end of the second arcuate sidewall, the first straight angled wall is supported by the first vertical connecting member affixed to the interior surface of the horizontal wall, the V-shaped ballast cover is affixed to the interior surface of the horizontal wall by screws, so that to remove the first diffuser lens, an inward force is applied to remove the first gap from the first channel receiving or gripping members of the first arcuate sidewall or the second gap is removed from the at least one second channel receiving or gripping members of the V-shaped ballast cover, the first diffuser lens covers the at least one LED;

f. light from at least one LED on a second LED board affixed to the interior surface of the main body is transmitted through a second diffuser lens, the second diffuser lens is arc-shaped and covers light from at least one LED on the second LED board affixed to the interior surface of the main body, the second diffuser lens is arc shaped having a first arcuate sidewall which terminates in a first bent hook end having a first gap within the first bent hook end, the second diffuser lens also has a parallel second arcuate sidewall which terminates in a second bent hook end having a second gap within the second bent hook end, a second reflector support assembly includes at least one second channel receiving or gripping members from the second angled wall of the V-shaped ballast cover inserted into the first bent hook end of the second diffuser lens and the at least one spaced apart second channel receiving or gripping member from the second straight angled wall inserted into the second bent hook end of the second diffuser lens, the second straight angled wall is supported by the second vertical interior transition wall affixed to the interior surface of the horizontal wall, the V-shaped ballast cover is affixed to the interior surface of the horizontal wall by screws, to remove the second diffuser lens, an inward force is applied to remove the first bent hook end of the second diffuser lens from the at least one second channel receiving or gripping member of the V-shaped ballast covers or the second bent hook end of the second diffuser lens is removed from the at least one spaced apart second channel receiving or gripping member of the second straight angled wall, the second diffuser lens covers the second LED board;

g. the first straight angled wall having a downward angle and terminates in a bottom end having a lower end having means to support the second lengthwise sidewall;

h. similarly the second straight angled wall has at a downward angle and terminates in a bottom end having means to support the first lengthwise sidewall;

i. the main body, the first transverse wall, the second transverse wall, the first lengthwise sidewall and the second lengthwise sidewall acting as a heat sink for the LED boards; and j. the first straight angled wall is not concave and not convex and the second straight angled wall is not concave and not convex.

12. The LED recessed direct lighting fixture in accordance with claim 11, further comprising: each diffuser selected from the group consisting of: being frosted and made of acrylic material, and being made of perforated metal.

13. The LED direct recessed lighting fixture in accordance with claim 11, further comprising:

a. the fixture is affixed to a ceiling structure by parallel oppositely disposed fine hanger bars, a first hanger bar has an upper rail which fits against the first lower horizontal section and the first vertical section of the first reflector support assembly and is affixed to the first lengthwise sidewall by a pair of attachment clips which is affixed to the first hanger bar by screws at one end and to the first lengthwise sidewall, at its opposite end; and b. similarly, a second hanger bar has as upper rail which fits against the second lower horizontal section and the second vertical wall of the second reflector assembly and is affixed to the second lengthwise sidewall by a second pair of attachment clips.

14. The LED recessed direct light fixture in accordance with claim 11, further comprising:

a. the first diffuser lens has a given width in the range of approximately three (3) inches to approximately eight (8) inches; and b. the second diffuser lens has a given width in the range of approximately three inches to approximately eight (8) inches.

15. An LED recessed direct lighting fixture comprising:

a. a housing having a first lengthwise sidewall, a second oppositely disposed lengthwise sidewall, a first transverse wall, a second transverse wall, a top surface, the first transverse wall perpendicular to the top surface and the second transverse wall perpendicular to the top surface;

b. a main body comprising a horizontal wall having a top surface and interior surface, a first straight angled wall which acts as a reflector and which extends at an angle relative to the top surface, a second straight angled wall which acts as a reflector and which extends at an angle relative to the top surface;

c. the first straight angled wall has at least one first channel receiving or gripping member, the second straight angled wall has at least one spaced apart second channel receiving or gripping member;

d. the fixture further comprises a V-shaped ballast cover having a first angled wall and at least one first channel receiving or gripping member, the V-shaped ballast cover also has a second angled wall extending to a second interior vertical connecting member, and at least one second channel receiving or gripping member;

e. light from at least one LED on a first LED board affixed to the interior surface of the main body is transmitted through a first diffuser lens, the first diffuser lens is arc shaped and is retained by the first channel receiving or gripping members of the first straight angled wall and a first channel receiving or gripping member from the V-shaped ballast cover, the first diffuser lens covers the first LED board;

f. light from at least one LED on a second and third LED boards affixed to the interior surface of the main body is transmitted through a second parallel diffuser lens which covers the second and third LED boards affixed to the interior surface of the main body, the second diffuser lens is arc shaped and is retained by the spaced apart second channel receiving or gripping members of the second straight angled wall and a second channel receiving or gripping member from the V-shaped ballast cover, the second diffuser lens covers the second and third LED boards;

g. the first straight angled wall has a downward angle and terminates in a bottom end having a lower end having means to support the second lengthwise sidewall;

h. similarly the second straight angled wall has a downward angle and terminates in a bottom end having means to support the first lengthwise sidewall;

i. the main body, the first transverse wall, the second transverse wall, the first lengthwise sidewall and the second lengthwise sidewall acting as a heat sink for the LED boards; and j. the first straight angled wall is not concave and not convex and the second straight angled wall is not concave and not convex.

16. A fluorescent light recessed direct lighting fixture comprising:

a. a housing having a first lengthwise sidewall, a second oppositely disposed lengthwise sidewall, a first transverse wall, a second transverse wall, a top surface, the first transverse wall perpendicular to the top surface and the second transverse wall perpendicular to the top surface;

b. a main body comprising a horizontal wall and having a top surface and interior surface of the top surface, the top surface extending to a first vertical interior transition wall and a first straight angled wall which extends at an angle relative to the top surface and terminates in a first lower grooved wall having a gap between the first lower grooved wall and the first straight angled wall, the top surface also comprising a second vertical interior transition wall extending to a second straight angled wall which extends at an angle relative to the top surface and terminates in a second lower grooved wall having a gap between the second lower grooved wall and the second straight angled wall, the first straight angled wall and second straight angled wall are mirror images of each other;

c. the first straight angled wall has a pair of spaced apart first channel receiving or gripping members, the second straight angled wall has a pair of spaced apart second channel receiving or gripping members;

d. the fixture further comprises a V-shaped ballast cover having a first angled wall and a first vertical interior transition wall, and a pair of spaced apart second channel receiving or gripping members located at the junction where the first angled wall contacts the first vertical interior transition wall of the V-shaped ballast cover, the V-shaped ballast cover also comprises a second angled wall, a second interior vertical transition wall, and a pair of spaced apart first channel receiving or gripping members located at the junction where the second angled wall contacts the second vertical interior transition wall of the V-shaped ballast cover;

e. light from a first fluorescent bulb is transmitted through a first diffuser lens, the first diffuser lens is arc shaped having a first arcuate sidewall which terminates in a first bent hook end having a first gap within the first bent hook end, the first diffuser lens also has a parallel second arcuate sidewall which terminates in a second bent hook end having a second gap within the second bent hook end, a first reflector support assembly which includes the pair of spaced apart first channel receiving or gripping members from the first straight angled wall inserted into the first gap in the first bent hook end of the first arcuate sidewall of the first diffuser lens and the pair of spaced apart second channel receiving or gripping members from the first angled wall of the V-shaped ballast cover are inserted into the second gap within the second bent hook end of the second arcuate sidewall, the first straight angled wall is supported by the interior transition wall of the main body affixed to the interior surface of the horizontal wall, the V-shaped ballast cover is affixed to the interior surface of the horizontal wall by screws, so that to remove the first diffuser lens, an inward force is applied to remove the first gap from the gripping members of the first straight angled wall or the second channel is removed from the spaced apart second channel receiving or gripping members of the V-shaped ballast cover, the first diffuser lens covers the first fluorescent bulb;

f. a second parallel diffuser lens covers a second fluorescent bulb, the second diffuser lens is arc shaped having a first arcuate sidewall which terminates in a first bent hook end having a first gap within the first bent hook end, the second diffuser lens also has a parallel second arcuate sidewall which terminates in a second bent hook end having a second gap within the second bent hook end, a second reflector support assembly includes the pair of spaced apart first channel receiving or gripping members from the second angled wall of the V-shaped ballast cover inserted into the first bent hook end of the second diffuser lens and the spaced apart second channel receiving or gripping members from the second angled wall inserted into the second bent hook end of the second diffuser lens, the second angled wall is supported by the second vertical interior transition wall of the main body affixed to the interior surface of the horizontal wall, the V-shaped ballast cover is affixed to the interior surface of the horizontal wall by screws, to remove the second diffuser lens, an inward force is applied to remove the first bent hook end of the second diffuser lens from the pair of spaced apart first channel receiving or gripping members of the V-shaped ballast covers or the second bent hook end of the second diffuser lens is removed from the spaced apart second channel receiving or gripping members of the second angled wall, the second diffuser lens covers the second fluorescent bulb;

g. the first straight angled wall having a downward approximately 45 degree angle and terminates in a bottom end having a first lower horizontal section extending to a first vertical section which extends to a first upper horizontal section which extends to a first upper vertical section, the bottom of the second lengthwise sidewall rests on the first upper horizontal section and against the first upper vertical section;

h. similarly the second straight angled wall having a downward approximately 45 degree angle and terminates in a bottom end having a second lower horizontal section extending to a second vertical section which extends to a second upper horizontal section which extends to a second upper vertical section, the bottom of the first lengthwise sidewall rests on the second upper horizontal section and against the second upper vertical section; and i. the first straight angled wall is not concave and not convex and the second straight angled wall is not concave and not convex.

17. The fluorescent light recessed direct lighting fixture in accordance with claim 16 further comprising:

a. a first opening in the top surface adjoining an opening in the first transverse wall with a first access door hingeably affixed to the top surface and covering the adjoined openings, a second opening in the top surface adjoining an opening in the second transverse wall with a second access door hingeably affixed to the top surface and covering the adjoined openings;

b. a driver housed within the fixture so that it is attached to and accessible from the first access door; and c. an emergency battery or second driver housed within the fixture so that it is attached to and accessible from the second access door.

18. The fluorescent light recessed direct lighting fixture in accordance with claim 16 further comprising:

a. a single driver attached to the interior wall of the top surface and is accessed by removing the V-shaped ballast cover and at least one diffuser.

19. The fluorescent light recessed direct lighting fixture in accordance with claim 16, further comprising: each diffuser being frosted and made of acrylic material.

20. The fluorescent light recessed direct lighting fixture in accordance with claim 16, further comprising: each diffuser being made of perforated metal.

21. The fluorescent light recessed direct lighting fixture in accordance with claim 16, further comprising: the first and second lengthwise sidewalls and first and second transverse walls of the housing forming a generally square shape.

22. The fluorescent light recessed direct lighting fixture in accordance with claim 16, where during a power failure in which power to the fixture is interrupted, the emergency battery will enable at least the fluorescent bulbs to provide illumination for a given period of time.

23. The fluorescent light recessed direct recessed lighting fixture in accordance with claim 16, further comprising dimming means by which the illumination from at least some of the fluorescent bulbs is dimmed.

24. The fluorescent light direct recessed direct lighting fixture in accordance with claim 16, further comprising:

a. the fixture is affixed to a ceiling structure by parallel oppositely disposed fine hanger bars, a first hanger bar has an upper rail which fits against the first lower horizontal section and the first vertical section of the first reflector support assembly and is affixed to the first lengthwise sidewall by a pair of attachment clips which is affixed to the first hanger bar by screws at one end and to the first lengthwise sidewall, at its opposite end; and b. similarly, a second hanger bar has as upper rail which fits against the second lower horizontal section and the second vertical wall of the second reflector assembly and is affixed to the second lengthwise sidewall by a second pair of attachment clips.

25. The fluorescent light recessed direct light fixture in accordance with claim 24, further comprising:

a. the first diffuser lens has a given width in the range of approximately three (3) inches to approximately eight (8) inches; and b. the second diffuser lens has a given width in the range of approximately three inches to approximately eight (8) inches.

* * * * *